US007228988B2

(12) United States Patent
Inamura

(10) Patent No.: US 7,228,988 B2
(45) Date of Patent: Jun. 12, 2007

(54) MEDICINE SUPPLY APPARATUS

(75) Inventor: Atsuo Inamura, Ota (JP)

(73) Assignees: Sanyo Electric Co., Ltd, Osaka (JP); Sanyo Electric Biomedical Co., Ltd., Osaka (JP)

( * ) Notice: Subject to any disclaimer, the term of this patent is extended or adjusted under 35 U.S.C. 154(b) by 416 days.

(21) Appl. No.: 10/742,399

(22) Filed: Dec. 18, 2003

(65) Prior Publication Data

US 2004/0134925 A1 Jul. 15, 2004

(30) Foreign Application Priority Data

Dec. 25, 2002 (JP) ..... 2002-374869
Dec. 25, 2002 (JP) ..... 2002-374889

(51) Int. Cl.
*B65D 83/00* (2006.01)

(52) U.S. Cl. ..... 221/65; 221/64; 221/241; 221/242; 221/279; 221/280

(58) Field of Classification Search ..... 221/2, 221/3, 4, 6, 17, 124, 130, 133, 19, 65; 53/154, 53/168
See application file for complete search history.

(56) References Cited

U.S. PATENT DOCUMENTS 4,255,918 A * 3/1981 Lancaster et al. ..... 53/556
4,653,668 A * 3/1987 Gibilisco et al. ..... 221/298
5,671,592 A * 9/1997 Yuyama et al. ..... 53/493
5,678,393 A * 10/1997 Yuyama et al. ..... 53/493
5,722,215 A * 3/1998 Yuyama ..... 53/374.4
5,829,632 A * 11/1998 Gehlert et al. ..... 221/268
5,852,911 A * 12/1998 Yuyama et al. ..... 53/168
5,875,610 A * 3/1999 Yuyama et al. ..... 53/75
5,946,883 A * 9/1999 Yuyama et al. ..... 53/154
6,471,088 B1 * 10/2002 Uema et al. ..... 221/4

* cited by examiner

*Primary Examiner*—Gene O. Crawford
*Assistant Examiner*—Michael K. Collins
(74) *Attorney, Agent, or Firm*—Darby & Darby

(57) ABSTRACT

A medicine supply apparatus to discharge a medicine into packing paper having a nozzle for discharging a medicine from a tablet case and a shutter rotatably provided in the nozzle for opening/closing a medicine drop path. The shutter includes a first rotatable shutter plate of a size capable of closing the inside of the nozzle, a second shutter plate swingably connected to the tip of the first shutter plate, and a guide for swinging the second shutter plate in a direction opposite to the direction of rotation of the first shutter plate in a final stage of the medicine discharge while the first shutter plate is opened. The tip of the second shutter plate is located in a position to narrow an outlet of the medicine drop path when the first shutter plate is opened.

3 Claims, 17 Drawing Sheets

MEDICINE SUPPLY APPARATUS

BACKGROUND OF THE INVENTION

The present invention relates to a medicine supply apparatus that supplies medicines contained in a tablet case by the quantity specified by a prescription of a doctor, or that supplies and packs the medicines in a hospital, a pharmacy, or the like.

In hospitals or pharmacies, a medicine supply apparatus (tablet packing apparatus) has been conventionally used to offer medicines prescribed by a doctor to a patient. In such an apparatus, the medicines (tablets, capsules, or the like) in the quantity described in a prescription are discharged from a discharge drum (alignment board) in a tablet case (tablet containing/supplying body) one by one, then collected by a hopper, then discharged and projected into packing paper (medicine packing sheet) folded in half via a nozzle, and then packed per dose (e.g. see JP-A-H08-11805).

In the nozzle for discharging and projecting the medicines into the packing paper folded in half, there is provided a shutter for controlling projection of the medicines by opening/closing a medicine drop path in the nozzle. On the other hand, the medicine drop path in the nozzle is configured such that an outlet thereof is narrowed so as to enable projection of the medicines even into packing paper having a small depth (width). Consequently, there has been a problem that when discharging a medicine such as a long capsule, the medicine is blocked or caught in the nozzle.

The packing paper rolled into a roll generally has a substantially V-shape in cross section, i.e. the packing paper is generally open at its upper end and folded at its lower end (folded in half), and the nozzle is inserted into the packing paper from above. Consequently, there has been a problem that wrinkles or slacks occur on the packing paper depending on the size of the nozzle to thereby cause failure in packing condition.

SUMMARY OF THE INVENTION

The present invention has been made for solving the foregoing conventional technical problems, and provides a medicine supply apparatus that can effectively solve medicine lodgment or blocking within a nozzle that discharges a medicine into packing paper.

Further, the present invention provides a medicine supply apparatus that is configured such that a wrinkle or slack is not liable to occur on packing paper due to a nozzle.

A medicine supply apparatus of the present invention is for supplying a medicine discharged from a tablet case containing the medicine, and comprises a nozzle for discharging the medicine discharged from the tablet case; and a shutter rotatably provided in the nozzle for opening/closing a medicine drop path in the nozzle, wherein the shutter comprises a first shutter plate that has a size capable of closing the inside of the nozzle and is rotated, a second shutter plate swingably connected to the tip of the first shutter plate, and a guide for swinging the second shutter plate in a direction opposite to a direction of rotation of the first shutter plate in a final stage where the first shutter plate is opened, and wherein the tip of the second shutter plate is located in a position to narrow an outlet of the medicine drop path when the first shutter plate is opened.

Further, a medicine supply apparatus of the present invention includes a tablet case containing medicines, and packing paper rolled into a roll in the state where the apacking paper is open at its upper end and folded at its lower end, packs the medicines discharged from the tablet case by the use of the packing paper, and comprises a nozzle for projecting the medicines discharged from the tablet case, into the packing paper continuously drawn out; heat seal means for sealing by heat welding an upper end opening of the packing paper having received the medicines from the nozzle, and partitioning the packing paper per pack; and tension applying means for applying tension to the packing paper in a direction to close the upper end opening of the packing paper to be sealed by the heat seal means.

In the foregoing medicine supply apparatus, the tension applying means may be movably provided and urged toward the packing paper by an elastic member.

DETAILED DESCRIPTION OF THE PREFERRED EMBODIMENT

Figure 1:
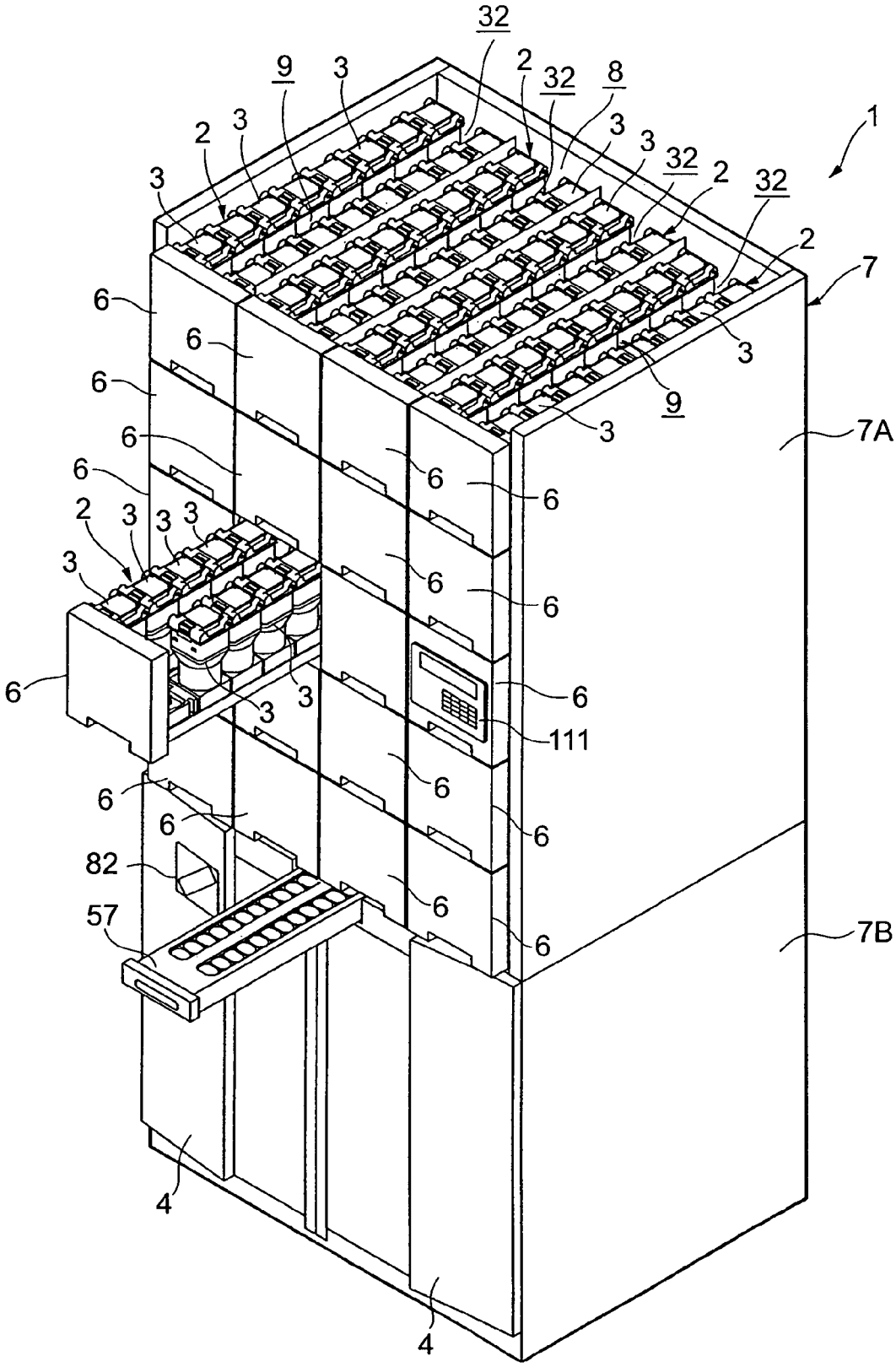
FIG. 1 is a perspective view of a medicine supply apparatus (excluding a top plate) of a preferred embodiment of the present invention.
Figure 2:
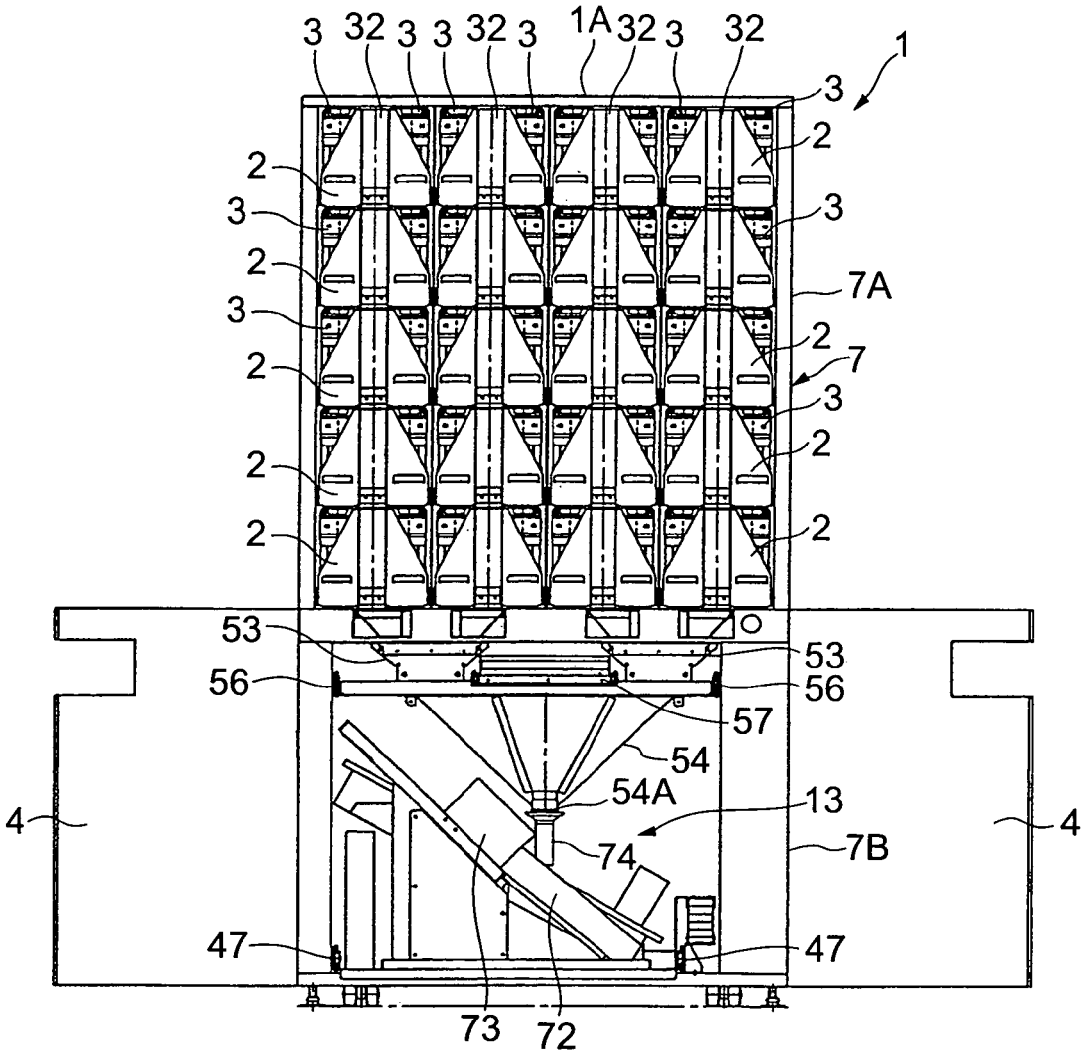
FIG. 2 is a front view of the medicine supply apparatus of FIG. 1 in the state where door panels of respective shelves are removed and lower panels are opened.
Figure 3:
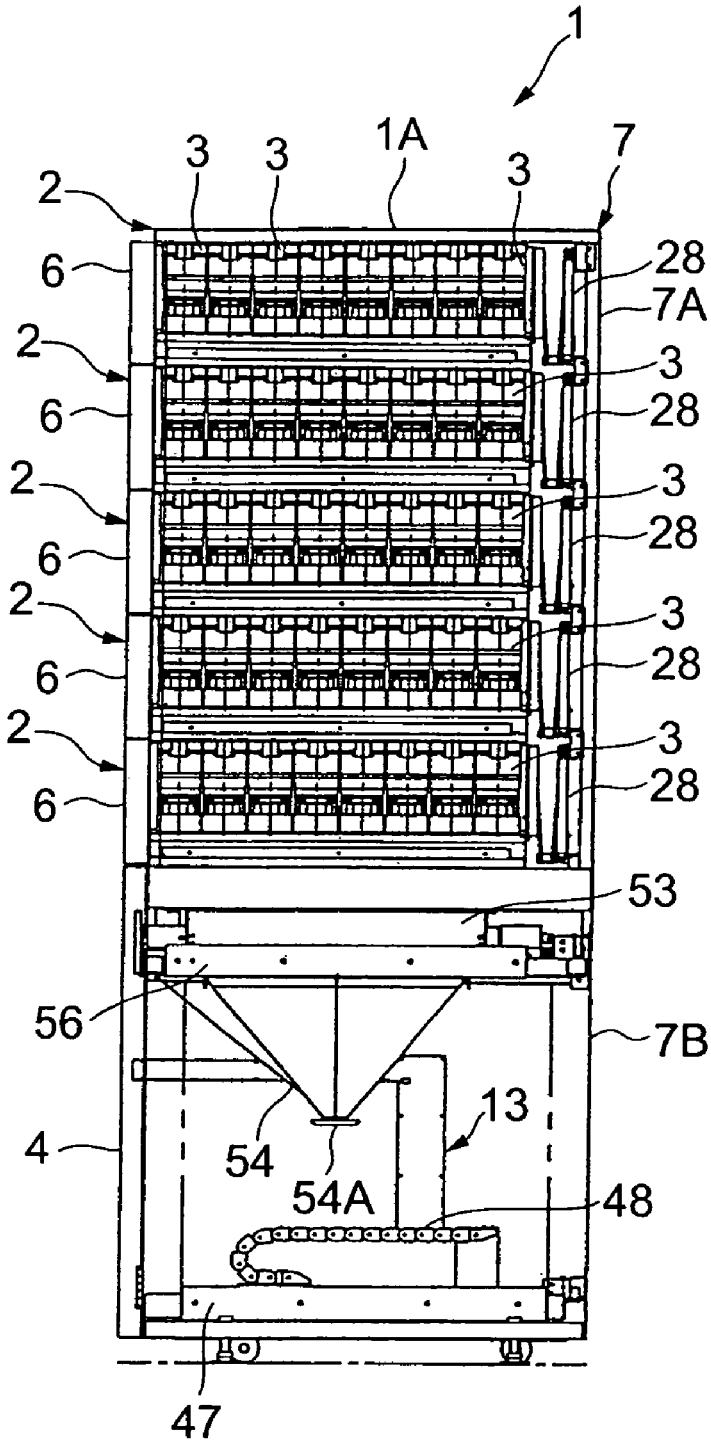
FIG. 3 is a longitudinal sectional side view of the medicine supply apparatus of FIG. 1.

Now, a preferred embodiment of the present invention will be described in detail with reference to the drawings. FIG. 1 is a perspective view of a medicine supply apparatus 1 (excluding a top plate 1A) of the preferred embodiment of the present invention, FIG. 2 is a front view of the medicine supply apparatus 1 in the state where door panels 6 . . . of respective shelves 2 . . . are detached and lower panels 4, 4 are opened, and FIG. 3 is a longitudinal sectional side view of the medicine supply apparatus 1.

The medicine supply apparatus 1 of the present invention is installed in a hospital, a pharmacy, or the like, and comprises a main body 7 having a laterally long rectangular shape, and a later-described personal computer for control. The main body 7 comprises an upper structural body 7A and a lower structural body 7B that are mutually separable from each other, and is configured that the upper structural body 7A is placed on the lower structural body 7B and joined thereto. The upper structural body 7A is provided therein with a case receiving portion 8 that is open on its front, upper, and lower sides for receiving therein later-described tablet cases 3 . . . , and the top surface of the case receiving portion 8 is closed by the detachable top plate 1A.

The lower structural body 7B is open on its front and upper sides, and communicates with the upper structural body 7A on the upper side thereof. A later-described packing machine 13 as a filling machine is received and disposed in the lower structural body 7B. The opening of the lower structural body 7B on the front side thereof is openably closed by the lower panels 4, 4 serving as double swinging doors.

In the case receiving portion 8 of the upper structural body 7A, the shelves 2 . . . are erected in four columns laterally and in five rows vertically (20 shelves in total). The door panel 6 is attached to the front end of each shelf 2 and, in the state where all the shelves 2 . . . are received in the case receiving portion 8, the door panels 6 close the front side opening of the upper structural body 7A (case receiving portion 8). In the middle of each shelf 2, a path 9 that is open on its upper and lower sides is formed so as to extend in a forward/backward direction. Drive bases (not shown) of the tablet cases 3 are mounted on both lateral sides (left and right sides) of the path 9, such that 8 drive bases are arrayed in the forward/backward direction on each side and 16 drive bases in total are arranged in parallel on both sides.

Each tablet case 3 comprises the drive base and a container (not shown) detachably attached thereon. In the drive base of the tablet case 3, a drum motor and an optical medicine detection sensor (either not shown) are attached, and a discharge chute (not shown) is formed. This discharge chute opens into the foregoing path 9. In FIG. 1, numeral 111 denotes a control panel.

On the other hand, the container of the tablet case 3 is open on its upper side, and this opening is openably closed by a cover. Further, a discharge drum is mounted in the container at the bottom thereof, and a plurality of vertical grooves are formed on the circumference of the discharge drum at predetermined intervals. While the discharge drum is rotated by the foregoing drum motor, medicines are discharged one by one into the path 9 from the discharge chute. The discharged medicines are detected by the foregoing medicine detection sensor and counted.

Each shelf 2 mounted with the tablet cases 3 . . . is drawably received in the case receiving portion 8. A harness 28 is provided at the rear end of each shelf 2 for energizing the drum motors of the tablet cases 3 . . . and transmitting outputs from the medicine detection sensors thereof.

In the state where the respective shelves 2 . . . are received in the case receiving portion 8, the paths 9 of the shelves 2 located vertically correspond to each other to thereby form a continuous chute 32 communicating vertically. Consequently, in this embodiment, four chutes 32 . . . each extending vertically are laterally arranged in the case receiving portion 8.

On the other hand, in the lower part of the lower structural body 7B of the main body 7, the packing machine 13 (filling machine) is disposed as described before. Although the structure of the packing machine 13 will be described later in detail, the packing machine 13 is, as shown in FIG. 3, detachably screwed to drawing rails 47, 47 mounted in the lower structural body 7B at the bottom thereof on the left and right sides. Thereby, the packing machine 13 can be drawn forward from the inside of the lower structural body 7B in the state where the lower panels 4, 4 are opened, and further, in the drawn state, the packing machine 13 is detachable from the drawing rails 47, 47 and attachable thereto. Incidentally, numeral 48 denotes a harness for the packing machine, which is detachably connected via connectors between the packing machine 13 and the lower structural body 7B. The harness has a length that can allow a sufficient drawing amount of the packing machine 13.

In the upper part of the lower structural body 7B, two opening/closing plates 53, 53 are laterally provided. The opening/closing plates 53, 53 are located so as to correspond to the downward directions of the foregoing chutes 32 . . . located over the opening/closing plates 53, 53. Specifically, in FIG. 2, the opening/closing plate 53 on the right as facing the drawing sheet corresponds to the chute 32 on the rightmost side as facing the drawing sheet and the chute 32 adjacent thereto, and the opening/closing plate 53 on the left as facing the drawing sheet corresponds to the chute 32 on the leftmost side as facing the drawing sheet and the chute 32 adjacent thereto. The opening/closing plates 53, 53 serve to temporarily receive medicines dropping into a later-described hopper 54 from the respective chutes 32 . . . .

The hopper 54 is provided in the lower structural body 7B at a position corresponding to the downward directions of the opening/closing plates 53, 53. The hopper 54 has a rectangular funnel shape opening wider toward the upper side and narrowing toward the lower end, and serves to receive the medicines having dropped from the chutes 32 . . . and passed through the opening/closing plates 53, 53 and discharge them from a lower end opening 54A.

The left and right upper ends of the hopper 54 are detachably screwed to drawing rails 56, 56 attached to left and right upper portions within the lower structural body 7B. The opening/closing plates 53, 53 are located on the upper side of the drawing rails 56, 56 and also detachably screwed to the drawing rails 56, 56, respectively. Thereby, the hopper 54 and the opening/closing plates 53, 53 are simultaneously drawable forward from the inside of the lower structural body 7B in the state where the lower panels 4, 4 are opened, and further, in the drawn state, the hopper 54 and the opening/closing plates 53, 53 are detachable from the drawing rails 56, 56 and attachable thereto. Although not shown, a harness for each opening/closing plate 53 is also provided detachably. This harness also has a length that can allow a sufficient drawing amount of the opening/closing plate 53.

With the structure as described above, when carrying out the maintenance, such as exchange of the tablet cases 3, cleaning of the chutes 32 . . . each formed by the paths 9, and the hopper 54, or exchange of parts of the packing machine 13, attaching/detaching operations can be implemented while they are drawn out from the upper structural body 7A or the lower structural body 7B of the main body 7.

Thereby, it becomes possible to remarkably improve the operability of maintenance of the medicine supply apparatus 1 so as to realize smooth medicine filling. Particularly, inasmuch as the plurality of tablet cases 3 can be simultaneously drawn out from the upper structural body 7A together with the shelf 2, and further, the containers of the tablet cases 3 are detachably attached, the operability of exchange of the containers of the tablet cases 3 can be further improved.

Moreover, since the opening/closing plates 53, 53 can also be drawn out from the lower structural body 7B and are detachably attached, it also becomes possible to improve the operability of maintenance of the opening/closing plates 53, 53 that serve to temporarily receive the medicines dropping into the hopper 54. Particularly, inasmuch as the opening/closing plates 53, 53 and the hopper 54 are attached so as to be simultaneously drawable from the lower structural body 7B, it becomes possible to further improve the operability upon carrying out the maintenance of the opening/closing plates 53, 53 and the hopper 54.

In the middle of the upper part within the lower structural body 7B, an additional medicine feeder (UTC) 57 is mounted between the opening/closing plates 53, 53. The additional medicine feeder 57 is not covered with the lower panels 4, 4 and can be independently drawn out forward, and further, is detachably attached (see FIG. 1). The additional medicine feeder 57 is a feeder for arbitrarily supplying additional medicines, and communicates with the inside of the hopper 54.

Now, referring to FIG. 4, the structure of the foregoing packing machine 13 will be described. Numeral 71 denotes a roll of heat-weldable packing paper 72 (forming containers), 73 a printer, 74 a nozzle attached to the lower end opening 54A of the hopper 54, 76 a heat seal head made of silicon rubber, 77 a roller for conveying the packing paper 72 drawn out from the roll 71, 79 a cutter for cutting the packing paper 72, and 81 a conveyor for conveying the packing paper 72, partitioned per pack and then cut, to a takeout port 82 (see FIG. 1) provided at the lower panel 4. The conveyor 81 is continuously provided along the conveying route of the packing paper 72. Numeral 83 denotes a motor for driving the heat seal head 76 (corresponding to heat seal means of the present invention) having a pair of heaters 29, 30 provided at a predetermined interval, 78 a motor for driving the roller 77, and 84 a motor for driving the conveyor 81.

The packing paper 72 rolled into the roll 71 has a substantially V-shape in cross section, i.e. the packing paper 72 is open on its upper side and folded at its lower end (folded in half). The packing paper 72 is once pulled out obliquely upward toward the right, as facing the drawing sheet, from the roll 71 by means of the roller 77 and so forth, then pulled out obliquely downward toward the right as facing the drawing sheet, thereafter, printing is performed on the surface thereof by the printer 73 as described later. Then, medicines discharged from the nozzle 74 are projected into the packing paper 72, and the packing paper 72 is partitioned per pack due to heat welding by the heat seal head 76. The packing paper 72 partitioned per pack is then cut by the cutter 79, and conveyed by the conveyor 81 to the takeout port 82 located left-upward as facing the drawing sheet.

Figure 5:
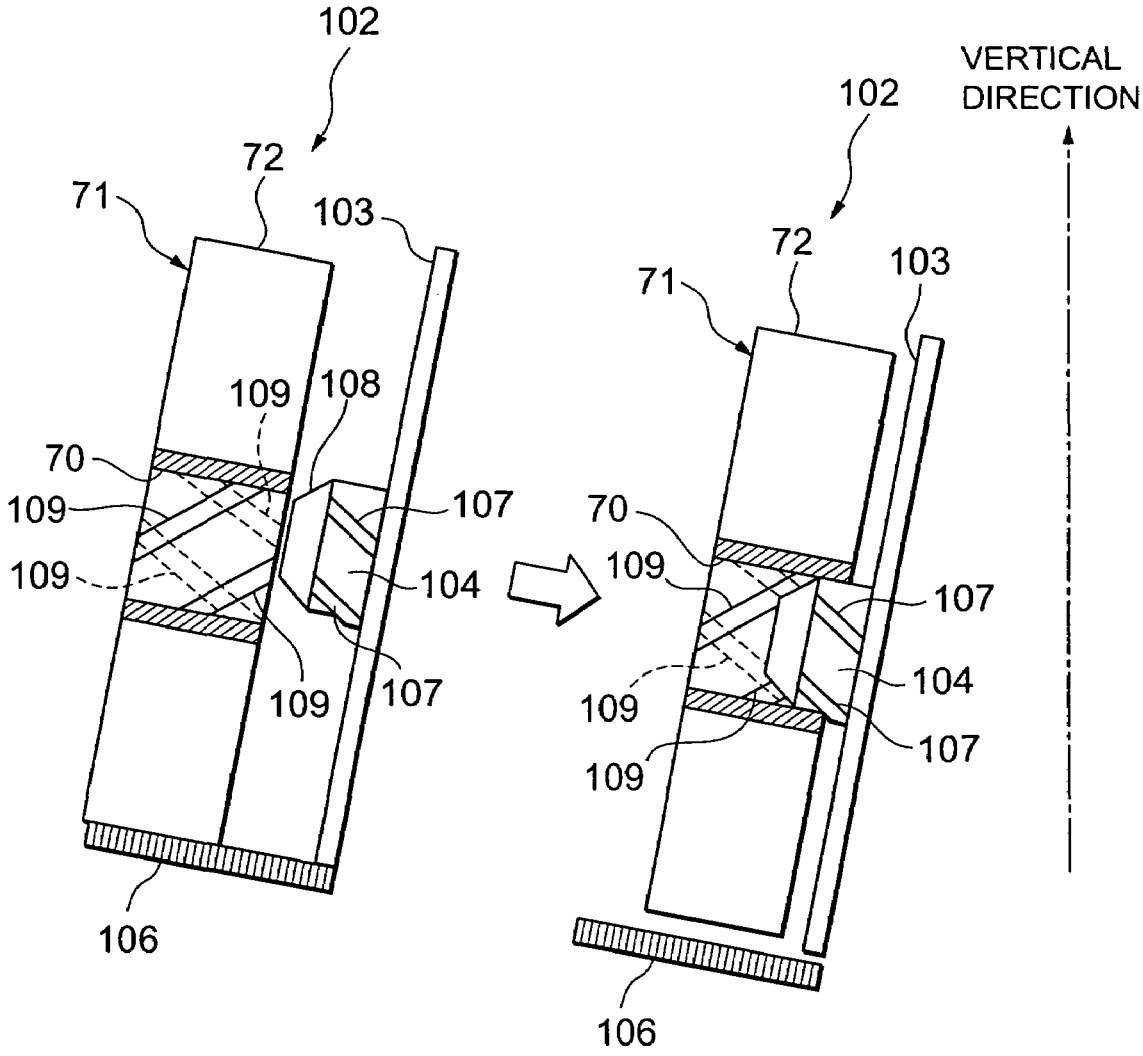
FIG. 5 is a diagram for explaining an operation of attaching a roll of packing paper to a packing paper feed mechanism of the medicine supply apparatus of FIG. 1.
Figure 6:
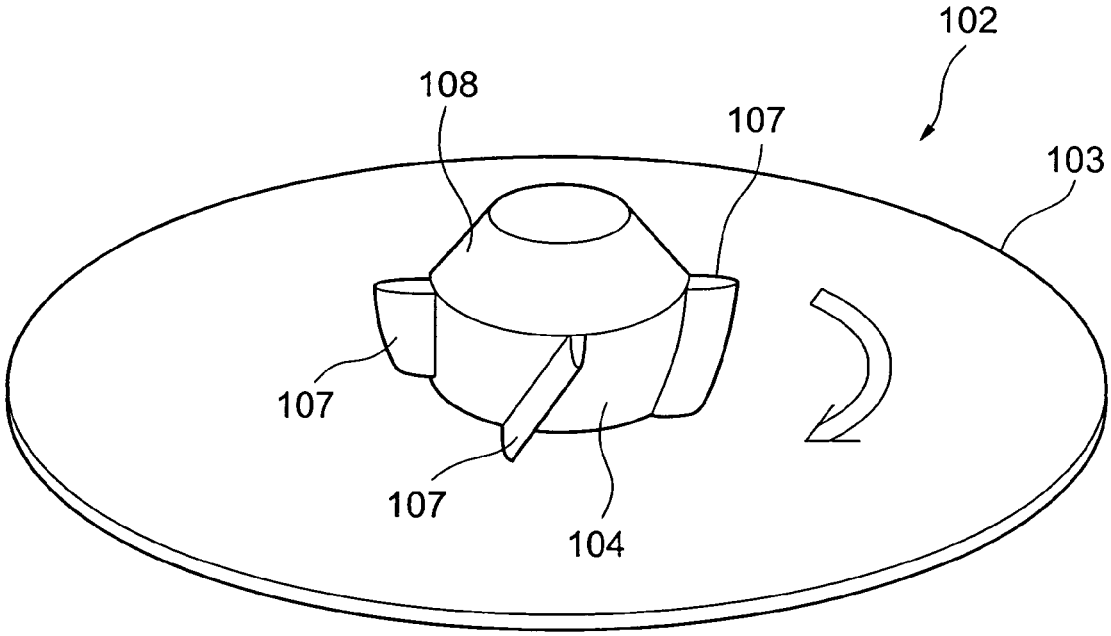
FIG. 6 is a perspective view of a base plate of the packing paper feed mechanism of FIG. 5.

In this embodiment, as shown in FIG. 5, the packing paper 72 is rolled on the circumference of a cylindrical shaft tube 70 made of synthetic resin, so as to be formed into the roll 71, and the roll 71 is detachably mounted onto a packing paper feed mechanism 102 provided at the lower part of a mounting plate 101 inclined obliquely upward toward the right, as seeing from the front, at an angle of about 20 degrees. As shown in FIG. 6, the packing paper feed mechanism 102 comprises a disk-shaped base plate 103, an engaging shaft 104 projected from the center of the base plate 103, a guide plate 106 provided correspondingly to the lower side of the base plate 103, and a brake mechanism (not shown) that contacts the lower side of the base plate 103.

The engaging shaft 104 is made of metal or synthetic resin and formed with, as shown in FIG. 6, a plurality of engaging projection strips 107 . . . on the circumference thereof. Each engaging projection strip 107 is formed so as to be inclined at a predetermined angle relative to an axial direction of the engaging shaft 104 (the engaging shaft 104 is projected obliquely upward toward the left from the base plate 103 in FIGS. 4 and 5), such that each engaging projection strip 107 extends from the tip of the engaging shaft 104 toward the base plate 103 in a direction of rotation, as shown by an arrow in FIG. 6, of the engaging shaft 104 and the base plate 103. The engaging shaft 104 is tapered at the tip thereof so as to be formed with a taper aportion 108 having a predetermined taper shape.

On the other hand, the inner diameter of the shaft tube 70 of the roll 71 is set to a value that allows tight engagement with the circumference of the engaging shaft 104. On the inner periphery of the shaft tube 70, there are formed a plurality of engaging grooves 109 . . . each having a depth that allows engagement with the engaging projection strip 107 of the engaging shaft 104, and each inclined in the same direction as that of the engaging projection strip 107 (broken lines in FIG. 5 are imaginary lines representing the engaging grooves 109 on this side).

On the other hand, as shown in FIG. 5, the guide plate 106 is disposed so as to be slightly spaced apart from the base plate 103, and located so as to correspond to at least the downward direction (obliquely downward toward the left in FIG. 5) of the engaging shaft 104. When mounting the roll 71 of the packing paper 72 onto the packing paper feed mechanism 102, the roll 71 is first placed on the guide plate 106 as shown on the upper side of FIG. 5, so as to carry out positioning between the shaft tube 70 and the engaging shaft 104. In this case, the guide plate 106 may have a curved shape such that a corresponding portion of the shaft tube 70 is located in the lowest position relative to the engaging shaft 104. This arrangement further facilitates the positioning.

When the roll 71 is moved toward the base plate 103 in this state, the inner edge of the upper side of the lower surface of the shaft tube 70 is brought into contact with the taper portion 108 of the engaging shaft 104 as shown on the upper side of FIG. 5 (the positional relationship between the base plate 103 and the guide plate 106 is suitably set according to the size of the roll 71 so as to become as described above). Then, when the roll 71 of the packing paper 72 is further moved toward the base plate 103, the shaft tube 70 is guided by the taper portion 108, and therefore, the roll 71 is raised to be separated from the guide plate 106, so that the axial center of the shaft tube 70 coincides with the shaft center of the engaging shaft 104. By providing the taper portion 108 and the guide plate 106 as described above, the positioning of the roll 71 becomes remarkably easy.

Then, when the roll 71 is rotated in the arrow direction in FIG. 6 to some extent, the engaging grooves 109 . . . on the inner periphery of the shaft tube 70 soon coincide with the engaging projection strips 107 . . . of the engaging shaft 104. Consequently, by rotating the roll 71 in the arrow direction of FIG. 6 in a screw-in manner so as to thrust it, the engaging projection strips 107 . . . advance into the engaging grooves 109 . . . to be detachably engaged therewith (the state on the right side in FIG. 5). Then, the roll 71 is finally placed on an upper surface of the base plate 103 so as to be mounted thereon.

As described above, inasmuch as the engaging projection strips 107 . . . of the engaging shaft 104 extend obliquely toward the base plate 103 in the rotation direction of the base plate 103 and the engaging shaft 104, a force exerted on the shaft tube 70 and the engaging shaft 104 upon feeding the packing paper 72 as will be described later, acts in a direction to further tighten the meshed engagement between the engaging projection strips 107 . . . and the engaging grooves 109 . . . . Consequently, even with a small projection length of the engaging shaft 104 (in this embodiment, a height of the taper portion 108 to its lower end is set to 10 mm), it is possible to prevent the roll 71 from coming off the engaging shaft 104.

In this embodiment, the engaging shaft 104 is projected obliquely upward at 45 degrees by the use of the inclination of the mounting plate 101. However, the present invention is not limited thereto and may be configured that the engaging shaft 104 is projected obliquely upward at a smaller angle including a horizontal angle (in this case, the base plate 103 is erected vertically).

Figure 4:
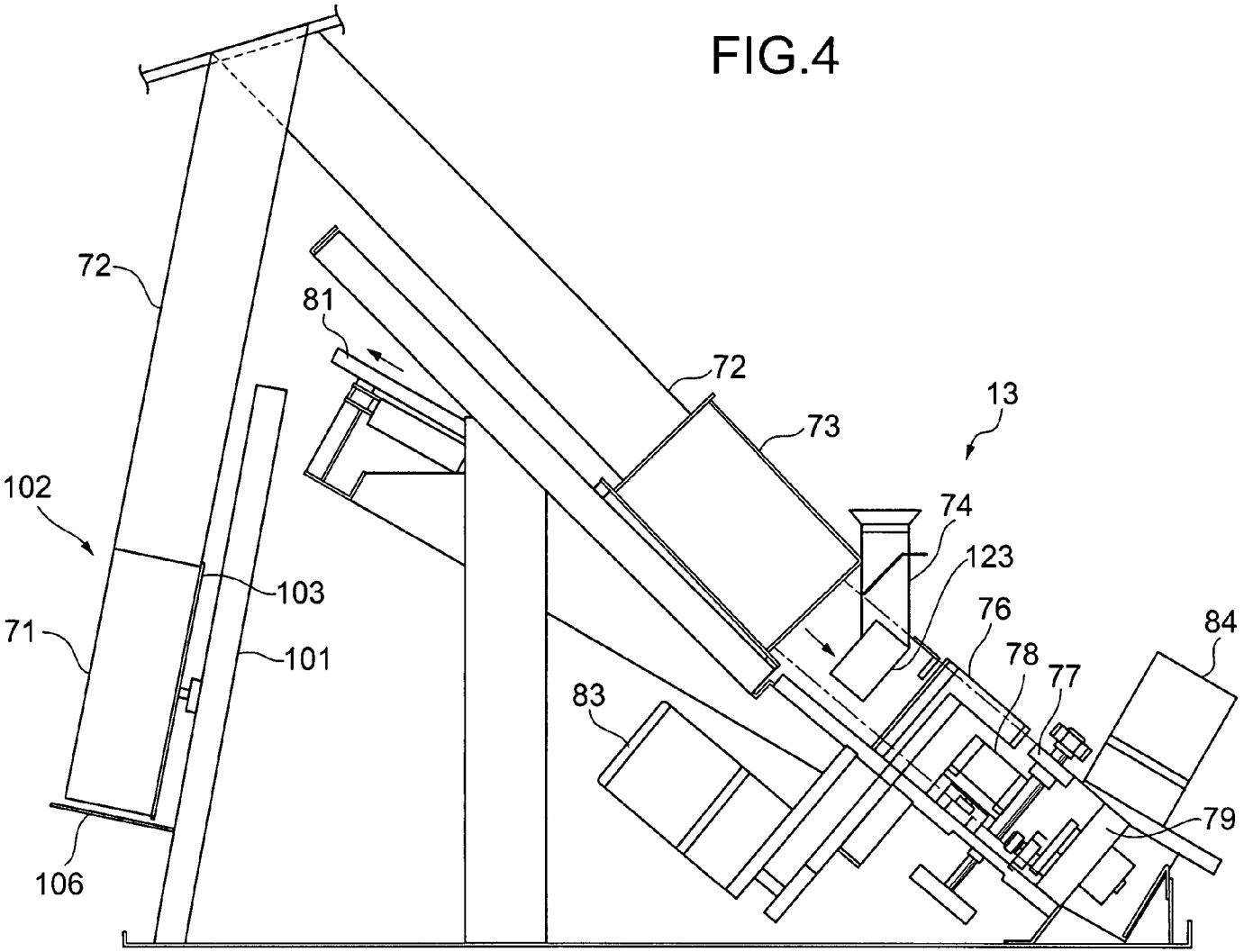
FIG. 4 is a front view of a packing machine of the medicine supply apparatus of FIG. 1.
Figure 7:
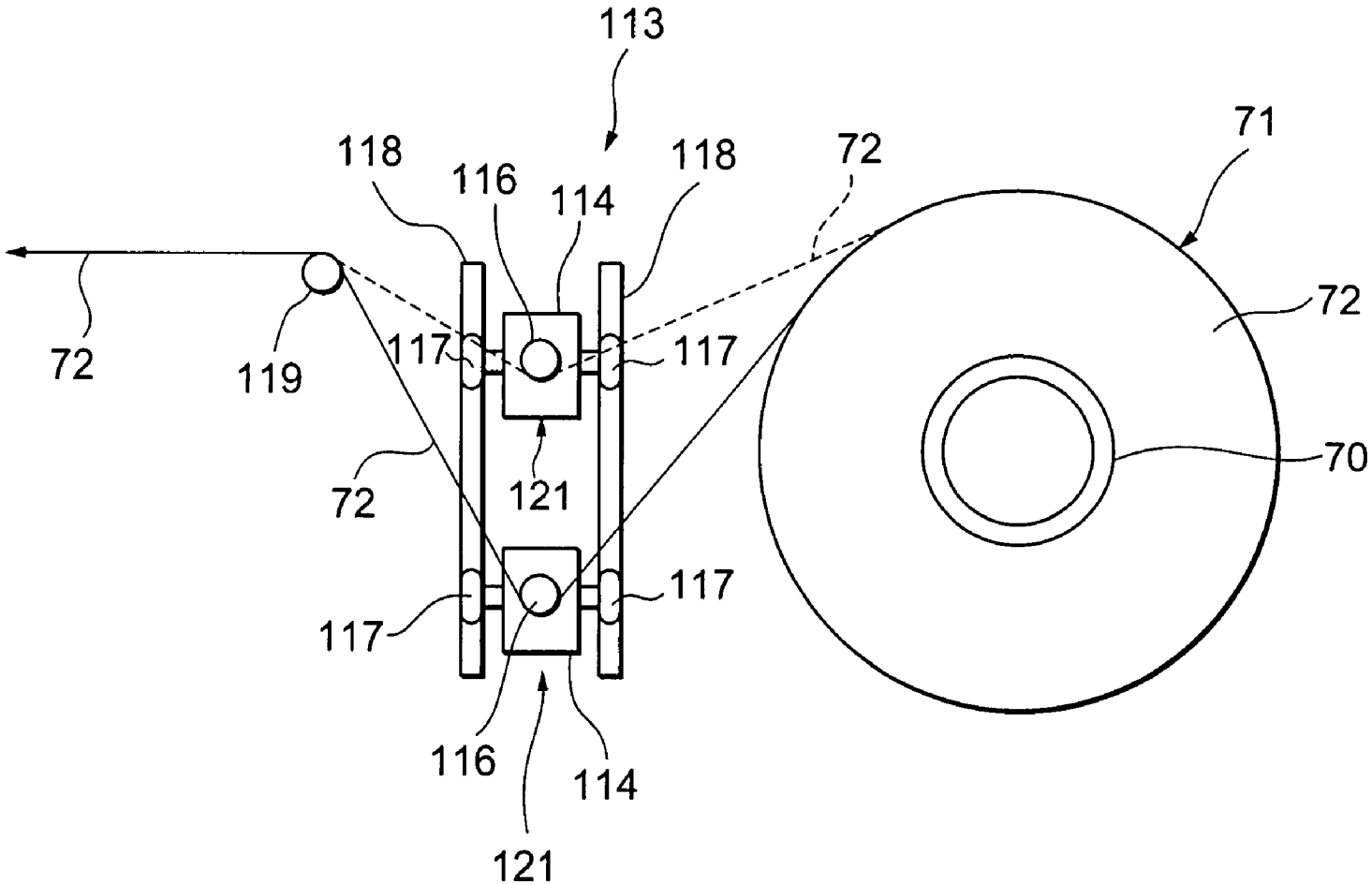
FIG. 7 is a front view of a tension applying mechanism for applying tension to the roll of the packing paper and the packing paper, of the medicine supply apparatus of FIG. 1.

FIG. 7 is a diagram wherein the roll 71 is seen from the obliquely left-upward direction in FIG. 4. A tension applying mechanism 113 is provided on the mounting plate 101 in the route between the roll 71 and the printer 73. The tension applying mechanism 113 comprises an acting portion 121 composed of a base portion 114 made of metal, and a rod-like body 116 formed by a round rod (circular in cross section) of metal projected from the base portion 114 and having a length sufficiently greater than a width of the packing paper 72, a pair of rollers 117, 117 provided so as to be projected from the base portion 114 on its both sides, a pair of rails 118, 118 on which the rollers 117, 117 are slidable, respectively, and a tension pin 119.

The acting portion 121 has a predetermined weight. The rails 118, 118 are provided in the direction of the inclination of the mounting plate 101, and thus, extend from the upper right to the lower left in FIG. 4 (in an upward/downward direction, or may be in a vertical direction). Thereby, via the sliding movement of the rollers 117, 117, the acting portion 121 including the rod-like body 116 is movable by its own weight along the rails 118, 118 in the upward/downward direction. The tension pin 119 is located at the upper part on the side opposite to the roll 71 with respect to the rails 118, 118. More specifically, the tension pin 119 is provided in a position such that, in the state where the rod-like body 116 depresses the packing paper 72 as will be described later, the packing paper 72 becomes substantially symmetrical on the left and right sides with respect to the rod-like body 116 (see FIG. 7). Thereby, it is configured that substantially equal forces are applied to the packing paper 72 on the left and right sides thereof with respect to the rod-like body 116.

With the structure as described above, the packing paper 72 drawn out from the roll 71 is set so as to pass the lower side of the rod-like body 116 of the tension applying mechanism 113, then reach the printer 73 from the upper side of the tension pin 119. Thereby, a force of the acting portion 121 descending by its own weight becomes a force of the rod-like body 116 depressing the packing paper 72, so that tension is applied to the packing paper 72.

Then, when the packing paper 72 is drawn out from the roll 71 by the foregoing roller 77 and so forth, the acting portion 121 is raised by a tensile force of the packing paper 72 as shown by a broken line in FIG. 7. Then, when the tensile force is weakened, the acting portion 121 descends again (the state shown by a solid line in FIG. 7). Thereby, the tension is applied to the packing paper 72 to prevent occurrence of wrinkles. As described above, inasmuch as the acting portion 121 of the tension applying mechanism 113 moves in the upward/downward direction to apply the tension to the drawn packing paper 72 by its own weight, the tension applied to the packing paper 72 is not affected by an operating position of the acting portion 121.

Consequently, it becomes possible to uniformly apply constantly fixed tension to the packing paper 72 that is rolled into the roll and continuously drawn out, thereby to effectively prevent both occurrence of wrinkles and occurrence of cutting due to excessive tension. Particularly, inasmuch as the tension applying mechanism 113 is formed by the acting portion 121 that depresses the packing paper, the rollers 117, 117 provided at the applying portion 121, and the upward/downward rails 118, 118 with which the rollers 117, 117 are slidably engaged, the acting portion 121 and the rollers 117, 117 can smoothly move along the rails 118, 118 by their own weight to thereby apply constantly stable tension to the packing paper 72.

Figure 8:
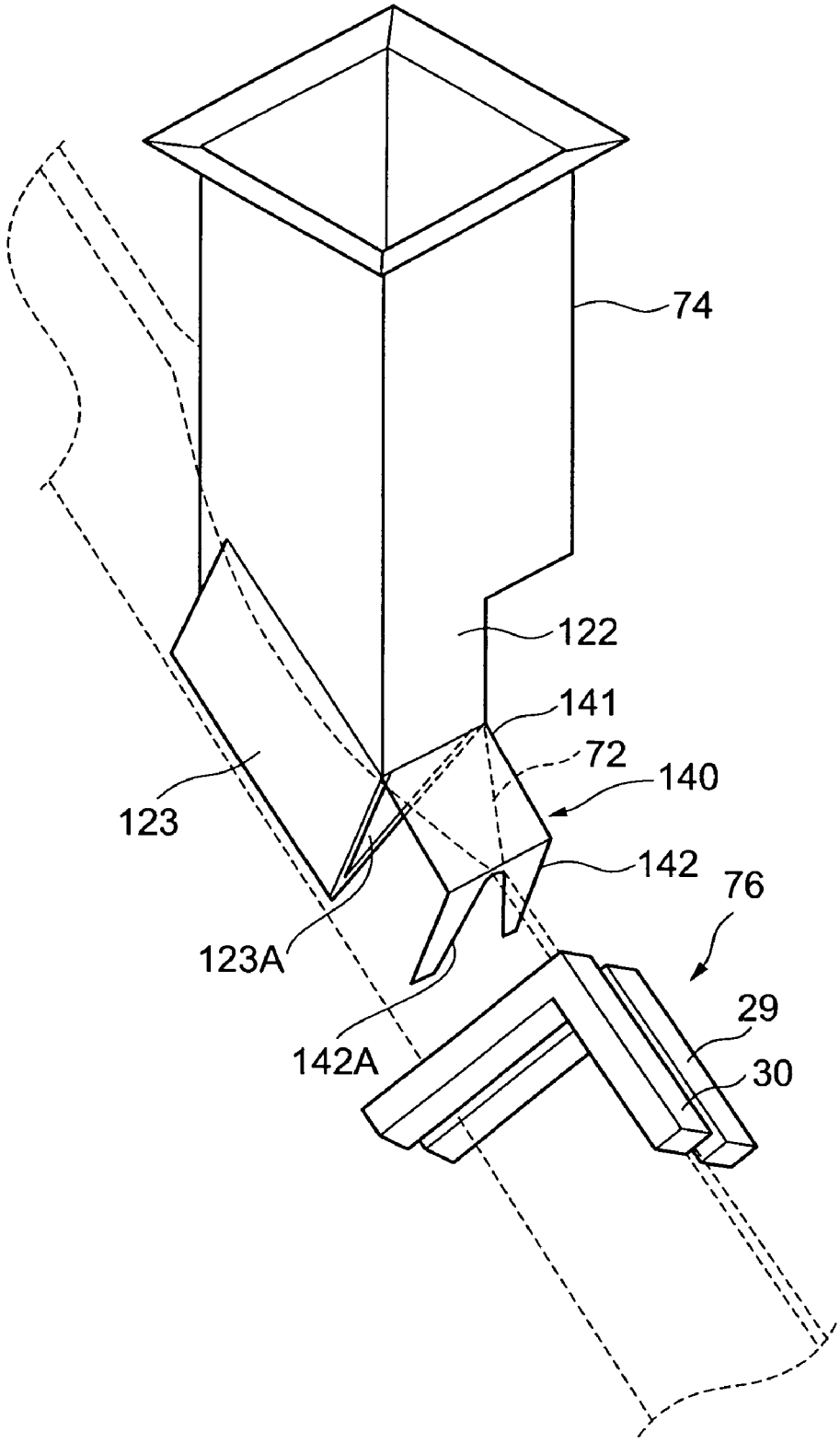
FIG. 8 is a perspective view of a nozzle of the medicine supply apparatus of FIG. 1.

As shown in FIG. 8, the foregoing nozzle 74 is provided so as to extend substantially vertically. The nozzle 74 has a shape of a rectangular tube that is open on its upper and lower sides, and an outlet portion of the nozzle 74 at the tip (lower part) thereof is formed as a width-narrowed portion 122 where a forward/backward width is narrowed toward the front side so as to be smaller than that of an inlet of the nozzle 74. The lower end of the width-narrowed portion 122 is open to serve as an outlet of a medicine drop path 75 formed in the nozzle 74 (in this embodiment, an inner depth of the medicine drop path 75 in the upper part of the nozzle 74 is 30 mm, and that of the width-narrowed portion 122 is 18 mm). In general, the packing paper 72 having a depth (width) of 74 mm or 43 mm is used. The width-narrowed portion 122 is formed so as to allow the nozzle 74 to be inserted into even the packing paper 72 having the smaller depth.

A packing paper guide 123 is attached to the width-narrowed portion 122 from the exterior. The packing paper guide 123 has a tapered shape, i.e. a substantially V-shape in cross section, and is disposed in a direction perpendicular to an advancing direction of the packing paper 72 (a 45-degree inclined direction from the upper left to the lower right) (see FIG. 9). The packing paper guide 123 is open on the forward and backward sides thereof (on the left and right sides in FIG. 4) in the advancing direction of the packing paper 72. Accordingly, a medicine dropped into the nozzle 74 can pass downward from the opening of the packing paper guide 123 (shown by a broken line arrow in FIG. 9) on the lower front side as shown by 123A in FIG. 8 (on the lower right side in FIG. 9).

The upper end opening of the nozzle 74 confronts the lower end opening 54A of the foregoing hopper 54, and the nozzle 74 is inserted into the packing paper 72 from the lower end of the packing paper guide 123. In this event, since the packing paper guide 123 has the V-shape in cross section, it is easy to insert the packing paper guide 123 from the upper side opening of the packing paper 72 folded in half as described before. If the nozzle 74 is configured to be slidable in the advancing direction of the packing paper 72, it becomes further easier to insert the packing paper guide 123 into the packing paper 72.

When the nozzle 74 is inserted into the packing paper 72, the packing paper 72 is bulged on its lateral sides relative to the advancing direction thereof over its length corresponding to a length of the nozzle 74 in the advancing direction of the packing paper 72, as shown by broken lines in FIG. 8. However, since the nozzle 74 attached with the tapered packing paper guide 123 is inserted into the packing paper 72, the packing paper guide 123 can retain the bulged state of the packing paper 72, so that occurrence of wrinkles or slacks can be prevented or minimized.

Figure 9:
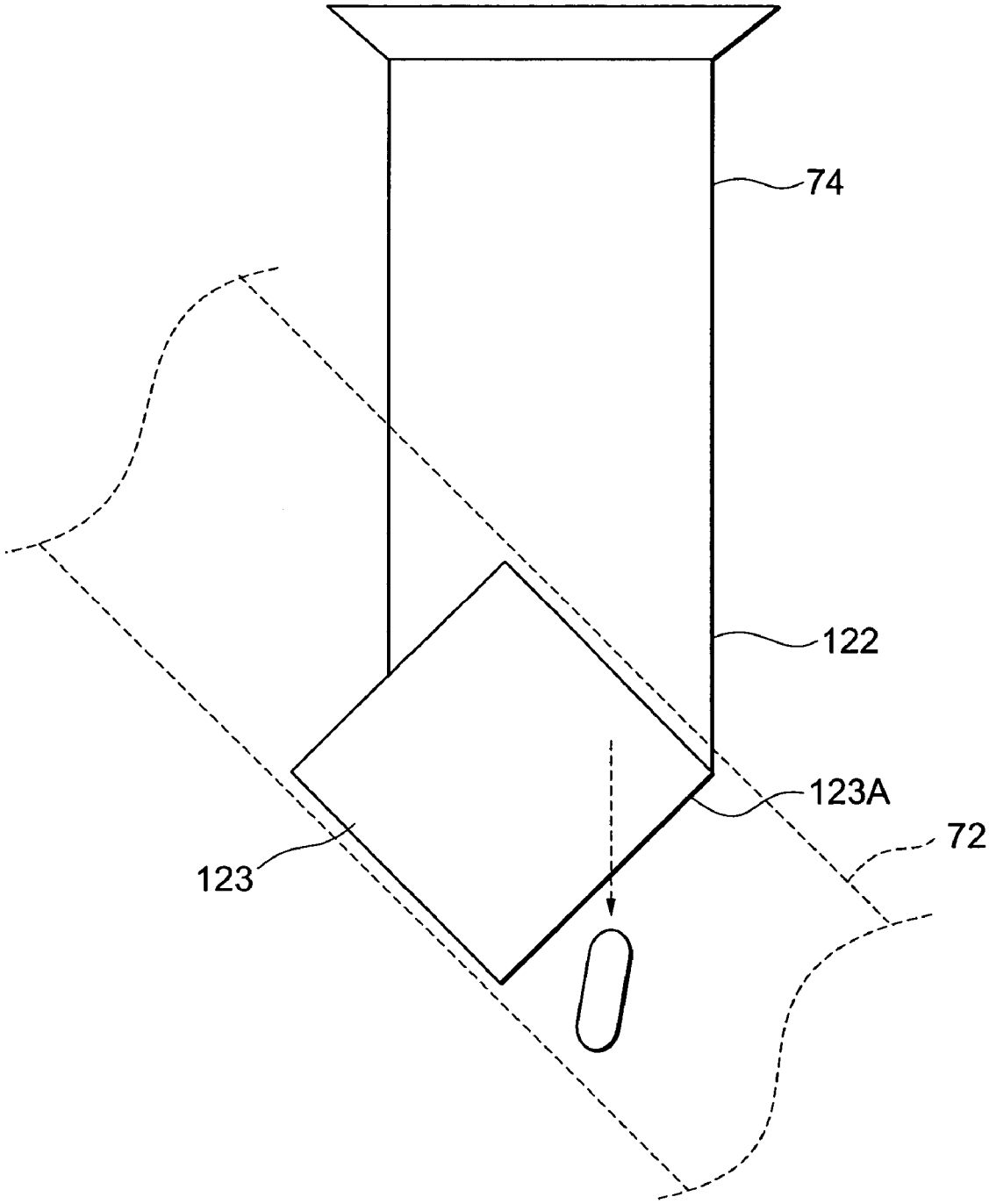
FIG. 9 is a front view of the nozzle of the medicine supply apparatus of FIG. 1.

Since the nozzle 74 is inserted into the packing paper 72, a medicine dropping into the hopper 54 and then entering the nozzle 74 passes through the foregoing opening of the packing paper guide 123 via the medicine drop path 75 so as to be projected into the packing paper 72 (see FIG. 9). In this event, since the bottom portion of the packing paper 72 is bulged by the packing paper guide 123, even if a large quantity of medicines are projected thereinto, the disadvantage of occurrence of wrinkles or slacks can be prevented or suppressed.

On the side of the heat seal head 76 at the lower end of the width-narrowed portion 122 of the nozzle 74, a packing paper shaping plate (packing paper shaping means) 140 is provided (see FIG. 8). Herein, if an opening of the packing paper 72 is closed and heat-welded (heat welding of the opening will be described later in detail) by the heat seal head 76 (heaters 29, 30) in the state where a large quantity of medicines are received at the bottom portion of the packing paper 72, inasmuch as the opening of the packing paper 72 is pushed open by the packing paper guide 123 due to the large quantity of the received medicines, it is not possible to finely close the opening. In view of this, the packing paper shaping plate 140 serves to close in advance the opening of the packing paper 72 having the large quantity of the received medicines at the bottom thereof, to an extent so as to keep a predetermined interval in the opening, then feed the packing paper 72 to the heat seal head 76 where the opening is fully closed and heat-welded.

The packing paper shaping plate 140 comprises an upper plate 141, and a longitudinal plate 142 continuously provided at an end of the upper plate 141 on the side of the heat seal head 76. One end side of the upper plate 141 is connected to the lower end of the width-narrowed portion 122 and extends in the advancing direction of the packing paper 72. On the other hand, the longitudinal plate 142 is formed by bending the other end side of the upper plate 141, and extends to the side of the packing paper 72 below so as to be perpendicular to the packing paper 72. The longitudinal plate 142 has a shaping portion 142A formed by cutting the longitudinal plate 142 from the lower end thereof. For allowing the upper edges of the packing paper 72 to be finely closed by the heat seal head 76, the shaping portion 142A has an upper portion (on the side of the upper plate 141) that is narrowed, and a lower portion that is widened to an extent so as not to contact the packing paper 72 having the large quantity of the projected medicines at the bottom thereof. That is, the shaping portion 142A is formed by cutting out the longitudinal plate 142 from the lower side thereof into an inverse V-shape. Further, the upper portion of the shaping portion 142A is so configured as to be spaced apart from the upper end of the packing paper 72 by a predetermined distance thereby not to contact the open end of the packing paper 72, and the shaping portion 142A is located in a position substantially intermediate between the lower front side 123A of the packing paper guide 123 and the heat seal heat 76.

Figure 10:
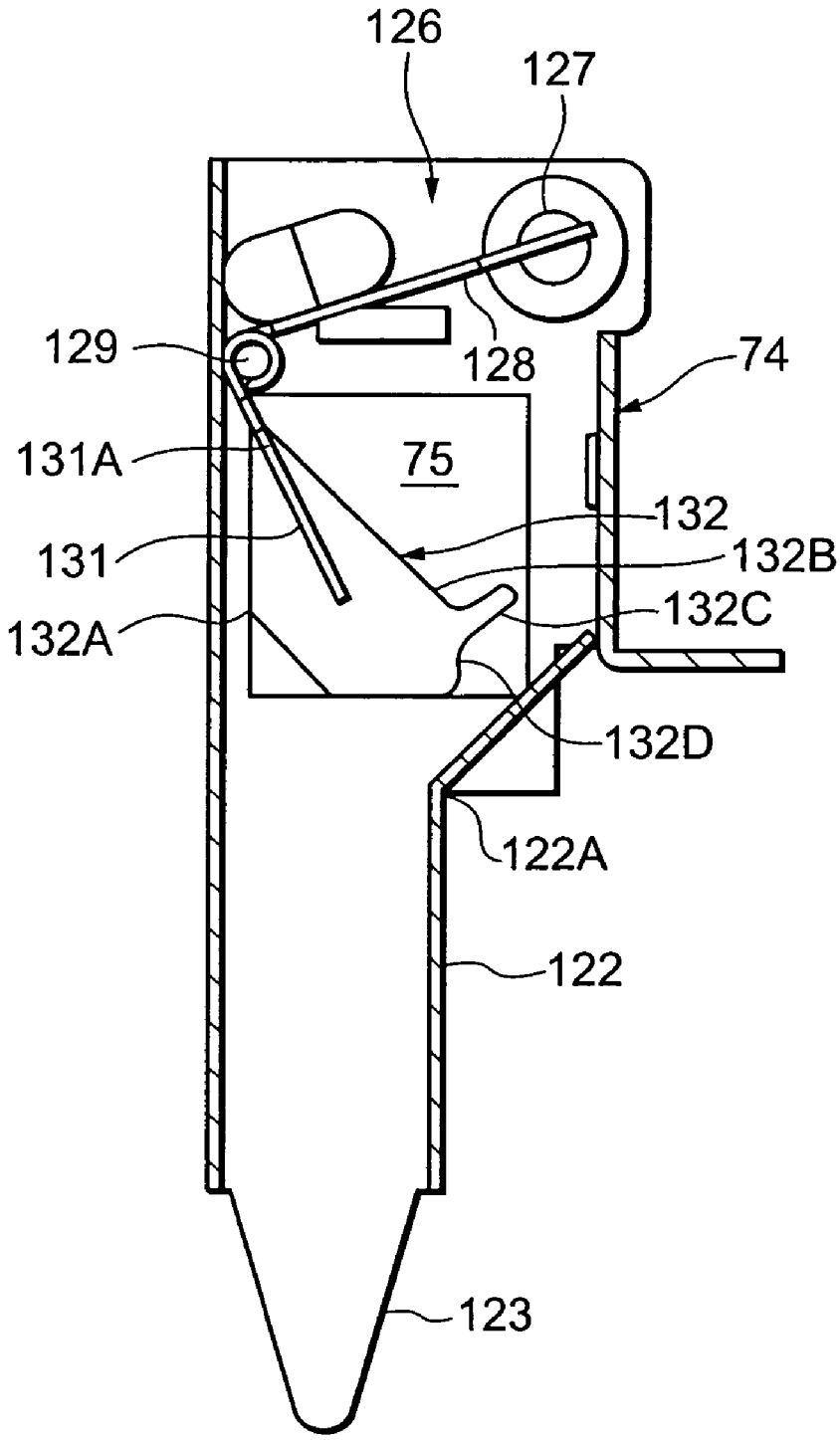
FIG. 10 is a longitudinal sectional side view of the nozzle of the medicine supply apparatus of FIG. 1.

Further, a shutter 126 as shown in FIG. 10 is provided in the nozzle 74. The shutter 126 comprises a first shutter plate 128 and a second shutter plate 131. An upper end portion of the first shutter plate 128 is rotated by a drive shaft 127 located in the upper part on a deep side of the nozzle 74, so that the first shutter plate 128 closes the medicine drop path 75. The second shutter plate 131 is swingably connected to the tip of the first shutter plate 128 by a rotation shaft 129.

The second shutter plate 131 is provided with guide pins 131A each projected in a position near the rotation shaft 129. The guide pins 131A are inserted into later-described guides 132, respectively. On both side walls of the nozzle 74, the guides 132 are formed so as to confront each other.

Each guide 132 comprises a side longitudinal side 132A formed vertically, an inclined side 132B inclined from the upper left to the lower right, and an inclined groove 132C inclined from the lower left to the upper right and having a width greater than that of the guide pin 131A. Thereby, the guide pin 131A can smoothly move within the inclined groove 132C. The inclined groove 132C is formed inside a locus described by the guide pin 131A that moves centering around the drive shaft 127 in the state where the first and second shutter plates 128, 131 are arrayed in a straight line, i.e. formed so as to be directed obliquely upward toward the right. Further, the side longitudinal side 132A is formed substantially vertical in a position below the rotation shaft 129 in the state where the drive shaft 127 is rotated counterclockwise to cause the first shutter plate 128 to close the medicine drop path 75. The side longitudinal side 132A is located in the position slightly deviating from the rotation shaft 129 toward the side of the drive shaft 127.

The inclined side 132B is formed so as to be directed obliquely downward toward the right in the figure from the upper end of the side longitudinal side 132A (direction in which the first shutter plate 128 is opened). The inclined groove 132C is formed at the lower end of the inclined side 132B so as to be directed obliquely upward toward the right, and an upper side of the inclined groove 132C is connected to the lower end of the inclined side 132B. On the other hand, a lower longitudinal side 132D at the lower end of the inclined groove 132C extends downward by a predetermined distance, then extends to the left so as to be connected to the lower end of the side longitudinal side 132A. The portion surrounded by them of the guide 132 is recessed on the side wall, the inclined groove 132C is also recessed on the side wall, and the guide pin 131A enters this recessed portion.

In the state where the first shutter plate 128 of the shutter 126 is rotated upward as shown in FIG. 10, the rotation shaft 129 at tip thereof contacts an inner wall of the nozzle 74 so that the first shutter plate 128 closes the medicine drop path 75 in the nozzle 74 (see FIG. 10). In this event, since the guide pin 131A of the second shutter plate 131 contacts the side longitudinal side 132A located in the position slightly deviating from the rotation shaft 129 toward the side of the drive shaft 127, the second shutter plate 131 is suspended by its own weight with the upper end side thereof being slightly inclined toward the inner side of the side wall, as shown in FIG. 10.

The shutter 126 serves to temporarily receive a medicine discharged from the hopper 54 into the nozzle 74. Upon packing, when opening the shutter 126 to drop the medicine, the first shutter plate 128 is rotated counterclockwise in FIG. 10 centering around the drive shaft 127 by driving means (not shown) such as a solenoid or motor. Then, when the drive shaft 127 is rotated from the closed state in FIG. 10 so that the rotation shaft 129 is separated from the side wall and the guide pin 131A is separated from the side longitudinal side 132A, the second shutter plate 131 is suspended from the rotation shaft 129 and, when further separated, the guide pin 131A moves to a substantially intermediate position of the medicine drop path 75 while the second shutter plate 131 is suspended from the rotation shaft 129 (see FIG. 11).

Thereby, the second shutter plate 131 is spaced apart from the side wall by a predetermined distance so that the medicine drop path 75 in the nozzle 74 is opened by a predetermined size. In this event, the guide pin 131A is spaced apart from the side longitudinal side 132A and the inclined side 132B by predetermined distances, respectively. In this state, a medicine in a longitudinal or lateral direction within the medicine drop path 75 that can pass a clearance between the second shutter plate 131 and the side wall drops into the width-narrowed portion 122.

Figure 11:
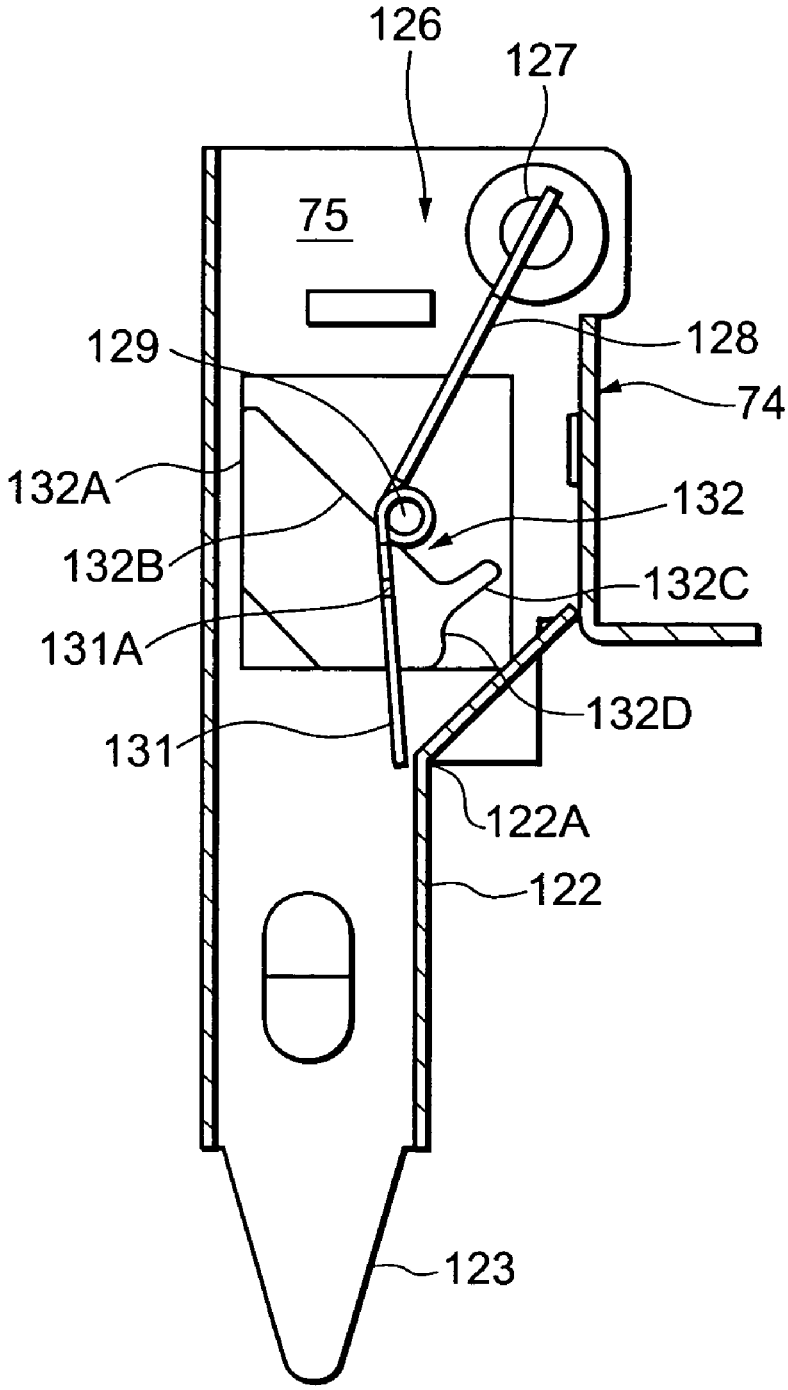
FIG. 11 is another longitudinal sectional side view of the nozzle of the medicine supply apparatus of FIG. 1.
Figure 12:
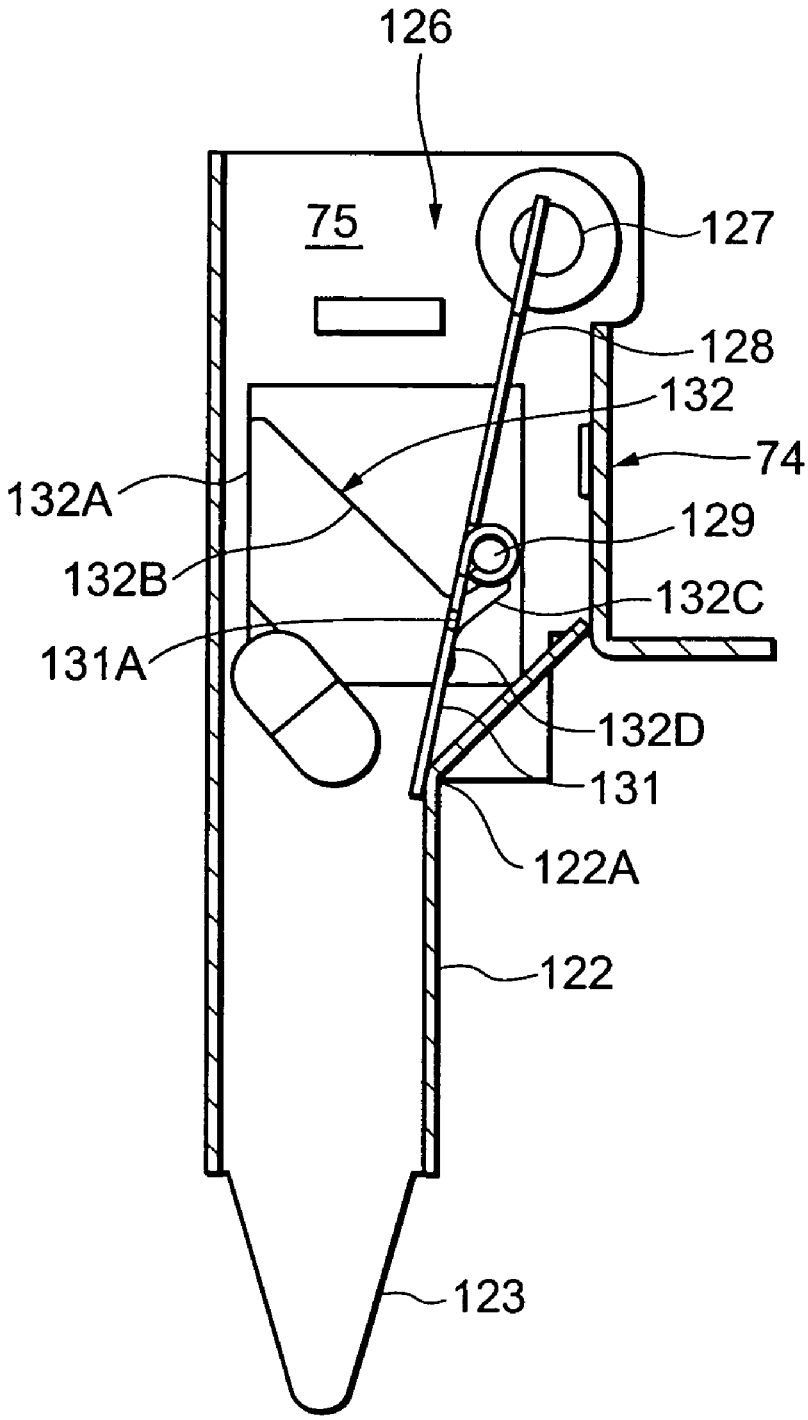
FIG. 12 is another longitudinal sectional side view of the nozzle of the medicine supply apparatus of FIG. 1.

Then, when the drive shaft 127 is further rotated from the state of FIG. 11, in the final stage where the first shutter plate 128 is opened, the guide pin 131A contacts the inclined groove 132C and the lower longitudinal side 132D at the lower end of the inclined groove 132C, and the lower end of the second shutter plate 131 contacts a corner 122A of the width-narrowed portion 122 (see FIG. 12). In this event, the guide pin 131A is set to be located at the entrance of the inclined groove 132, or just below the inclined groove 132C. In this state, a medicine in the medicine drop path 75 that drops in an inclined posture through a clearance between the first shutter plate 128 and the side wall (a medicine that is not blocked or caught in a clearance between the second shutter plate 131 and the side wall in this state) drops into the width-narrowed portion 122.

Then, when the drive shaft 127 is further rotated from that state, the rotation shaft 129 is further spaced apart from the side wall, while the guide pin 131A is prevented from further movement by the lower longitudinal side 132D, so that the second shutter plate 128 starts to rotate clockwise in the figure centering around the rotation shaft 129. When the first shutter plate 128 is further rotated counterclockwise in the state where the guide pin 131A is prevented from further movement by the lower longitudinal side 132D, the guide pin 131A advances into the inclined groove 132C to contact the lower side of the inclined groove 132C so that the second shutter plate 131 is further rotated clockwise, and finally, the first shutter plate 128 and the second shutter plate 131 are bent into a >-shape using the rotation shaft 129 as a fulcrum (see FIG. 13).

Figure 13:
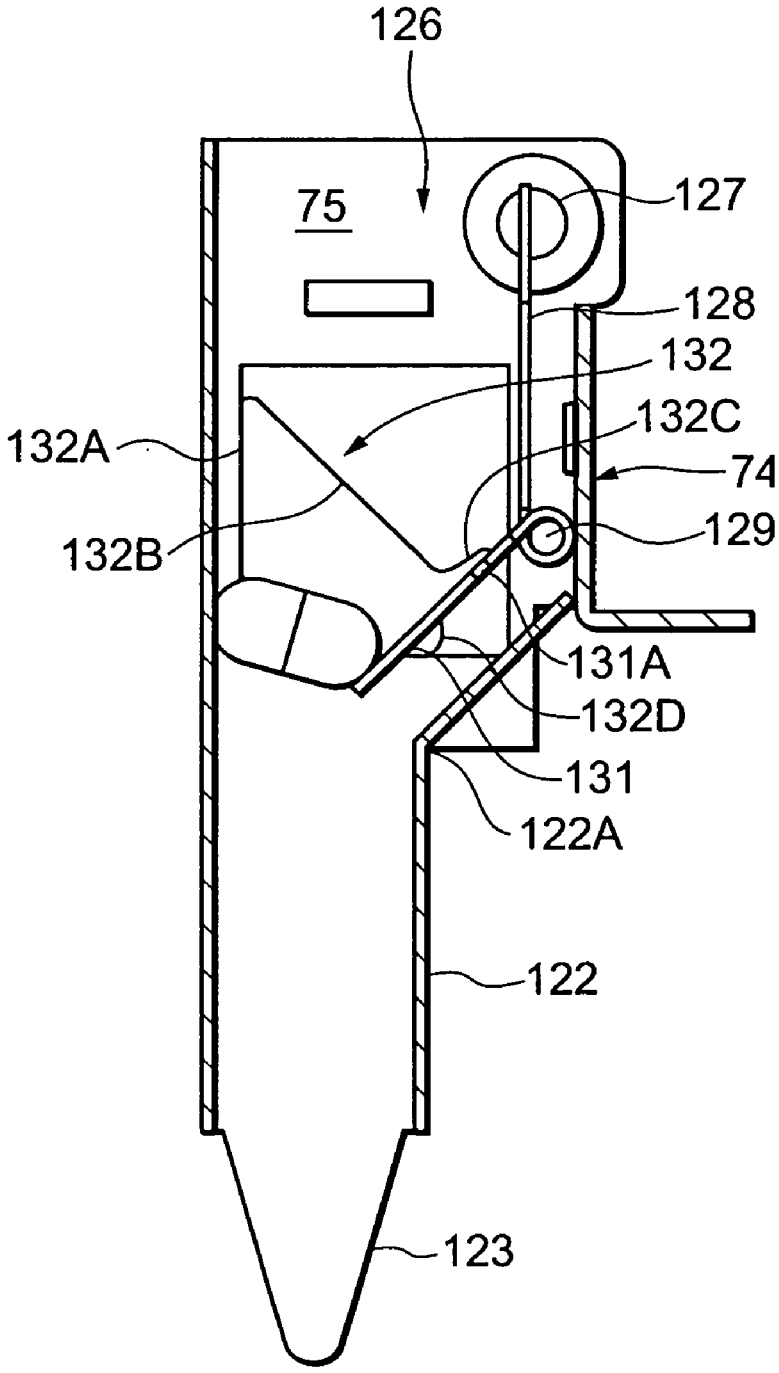
FIG. 13 is still another longitudinal sectional side view of the nozzle of the medicine supply apparatus of FIG. 1.

Specifically, in the final stage where the medicine drop path 75 is opened from the closed state thereof shown in FIG. 10, the second shutter plate 131 is rotated in a direction opposite to a direction of rotation of the first shutter plate 128, as shown in FIG. 13. In this state, the outlet of the medicine drop path 75 in the nozzle 74 is narrowed by the tip (lower end) of the second shutter plate 131. Thereby, a medicine dropping to the outlet of the medicine drop path 75 in a posture that is sometimes blocked, is caught between the tip of the second shutter plate 131 and the side wall. Incidentally, in FIGS. 10 to 13, a flange of the nozzle 74 at the upper end thereof shown in FIG. 9 is omitted.

Herein, the maximum medicine may have a length of about 25 mm. Therefore, when the shutter 126 is opened to drop the medicine, if the medicine attempts to advance into the width-narrowed portion 122 in a substantially horizontal posture as shown in FIG. 13, it is caught there because the width has been narrowed there. That is, in the final stage where the shutter 126 is opened to open the medicine drop path 75, the lower end of the second shutter plate 131 is swung in the direction opposite to the direction of rotation of the first shutter plate 128 thereby to positively catch such a medicine that attempts to advance into the width-narrowed portion 122 in the substantially horizontal posture. In this event, the caught medicine is on the lower end of the second shutter plate 131.

Then, the first shutter plate 128 is rotated in a closing direction (clockwise) from this state, the guide pin 131A moves in the inclined groove 132C obliquely downward toward the left from the upper right, which is reverse to the foregoing, while contacting the upper side of the inclined groove 132C. Thereby, since the second shutter plate 131 swings counterclockwise, which is opposite to the direction of rotation of the first shutter plate 128, from the state of FIG. 13, an acting force is exerted to lower the right end, as facing the drawing sheet, of the medicine in the state shown in FIG. 13. Thereby, the caught medicine changes its posture to take a new posture that can enter the width-narrowed portion 122, and therefore, drops into the width-narrowed portion 122.

FIGS. 10 to 13 show the state where one medicine is blocked. When several medicines are blocked, the swinging motion of the second shutter plate 131 changes postures of the several blocked medicines. In any event, blocking of a large-sized medicine can be solved by the foregoing structure of the shutter 126. On the other hand, if the blocking still occurs, a controller (not shown) gives an alarm.

The foregoing controller controls the foregoing driving means to open/close the shutter 126 at timing where the medicine is not easily blocked. On the other hand, by slowly operating the driving means, it is possible to relax an impact to a medicine, or prevent bouncing of a medicine.

As a method for this, there is available, for example, a method of gradually applying input voltage to a solenoid, or a method of providing a predetermined mechanical damper.

Figure 14:
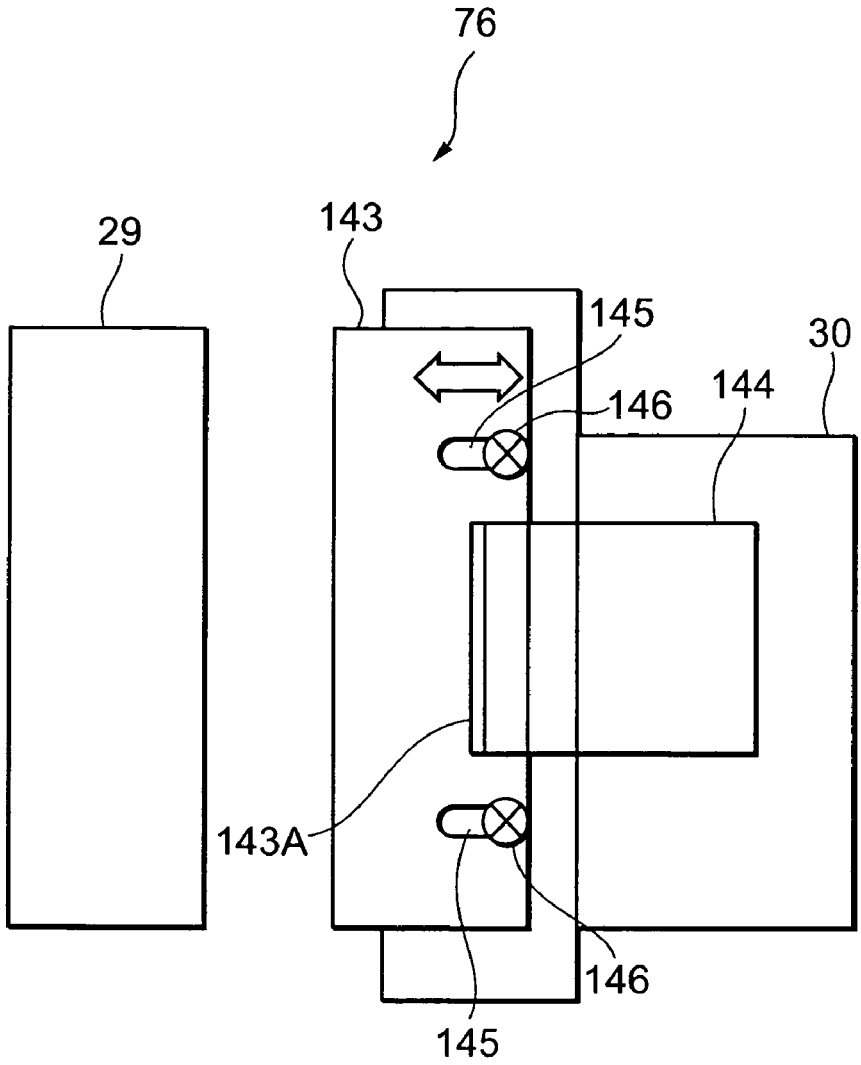
FIG. 14 is a side view of a heat seal head portion.

On the other hand, the heat seal head 76 is provided with tension applying means of the present invention. This tension applying means applies tension in a direction to close the upper end opening of the packing paper 72 to be welded by the heat seal head 76, and comprises a movable member 143, and a plate spring 144 (corresponding to an elastic member of the present invention) for urging the movable member 143 toward the side of the packing paper 72 (see FIG. 14).

The movable member 143 is located on the side surface of the heater 30, on the side of the nozzle 74, of the heat seal head 76, and is movable to the side of the other heater 29. The movable member 143 is formed with a pair of elongate holes 145, 145 (elongate toward the other heater 29) at a predetermined interval therebetween., and screws 146, 146 are movably inserted through the elongate holes 145, 145, respectively, and fixed to the side surface (on the side of the shaping portion 142A) of the heater 30. The movable member 143 has a length extending over the packing paper 72 folded in half from the folded portion side (lower end) to the upper end opening.

A reception wall 143A cut and raised substantially perpendicular is provided between the elongate holes 145, 145 of the movable member 143. This reception wall 143A is brought into contact with the plate spring 144 so that the movable member 143 is constantly urged toward the side of the heater 29. In the state where the reception wall 143A is urged toward the side of the heater 29 by the plate spring 144, the other side of the movable member 143 is projected over the heater 30 toward the side of the heater 29 by a predetermined distance.

Figure 15:
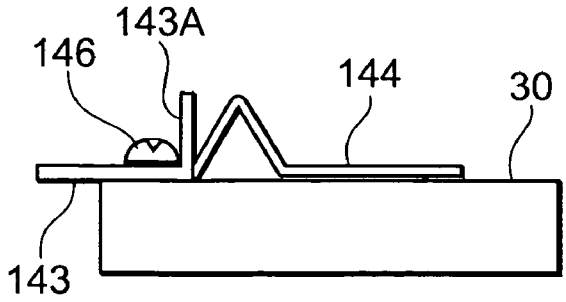
FIG. 15 is a bottom view of the heat seal head portion of FIG. 14 (excluding the other heater)

The plate spring 144 is formed by folded resin, and one side thereof is fixed to the heater 30 by screws (not shown) (in FIG. 15, the heater 29 is not shown). The plate spring 144 is given tension that does not damage the packing paper 72 upon pushing the packing paper 72 with the movable member 143. As the plate spring 144, a plate spring made of synthetic resin that is reluctant to be deformed at temperatures of the heaters 29, 30, is used. The plate spring 144 may be made of metal, or a coil spring may be used therefor.

Figure 16:
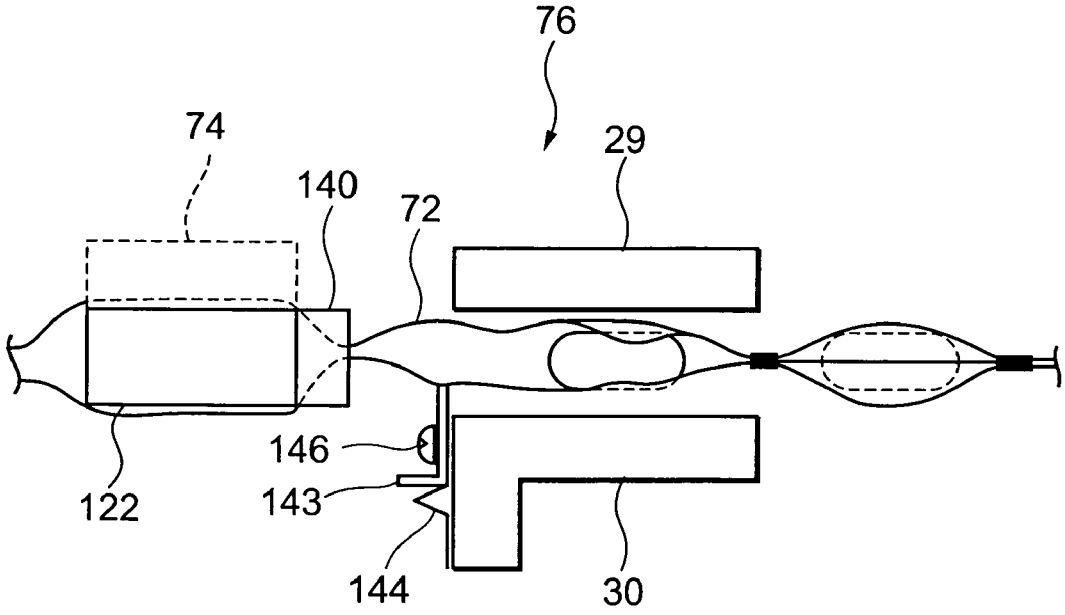
FIG. 16 is a diagram showing an advancing state of the packing paper at the heat seal head portion.

The packing paper 72 is drawn out from the roll 71 by the roller 77, then a medicine is projected into the packing paper 72 via the packing paper guide 123 and, while the packing paper 72 with the opened upper end opening passes through the packing paper shaping plate 140, the opening of the packing paper 72 is narrowed and closed to a predetermined width by the shaping portion 142A (see FIG. 16). In this event, since the lower portion of the shaping portion 142A is widened as described before, even the packing paper 72 having a large quantity of projected medicines at the bottom thereof can easily advance to the side of the heat seal head 76. Further, since the other side of the movable member 143 is projected over the heater 30 toward the side of the heater 29 only by the predetermined distance, the movable member 143 does not contact the packing paper 72 or slightly contacts the packing paper 72, thereby not to obstruct the advancement of the packing paper 72.

Figure 17:
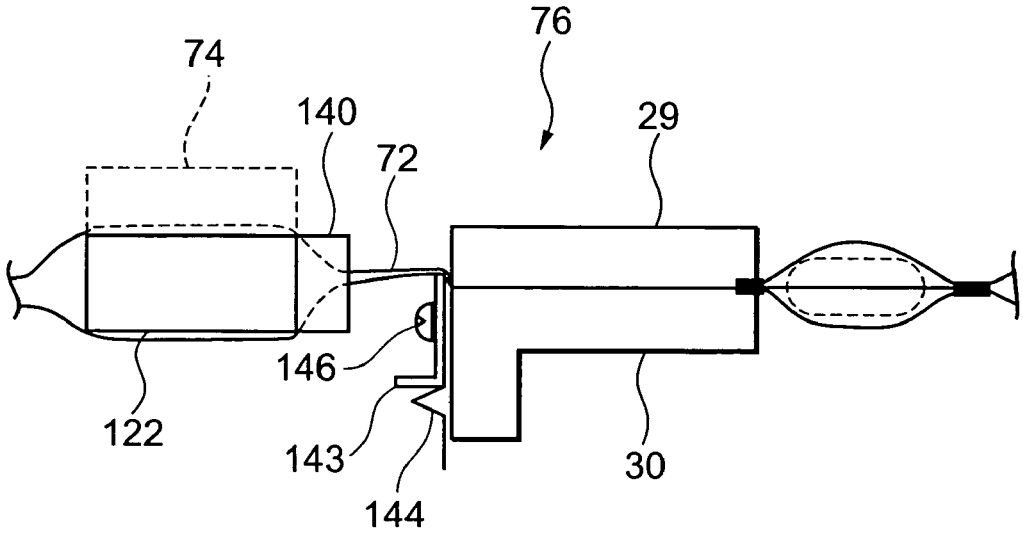
FIG. 17 is a diagram showing the state where a heat seal head of FIG. 16 is closed.

Then, both heaters 29, 30 are closed to thereby close the opening of the packing paper 72 and heat-weld it. In this event, since the other side of the movable member 143 is projected over the heater 30 toward the side of the heater 29 by the predetermined distance, the opening of the packing paper 72 is pushed toward a further side exceeding a contact surface, with the heater 30, of the heater 29 (i.e. a heating surface) by an elastic pressure of the plate spring 144 via the movable member 143. Thereby, the opening of the packing paper 72 is pressed against the contact surface of the heater 29. Therefore, even if a slack occurs at the opening of the packing paper 72 while it is closed, the slack can be absorbed by pushing the packing paper 72 to the further side exceeding the contact surface of the heater 29 by the elastic pressure of the plate spring 144 via the movable member 143 (see FIG. 17). Thereby, wrinkles or slacks that are generated at the opening (heat-welded portion) upon heat welding of the packing paper 72, can be extended before carrying out the heat welding.

Figure 18:
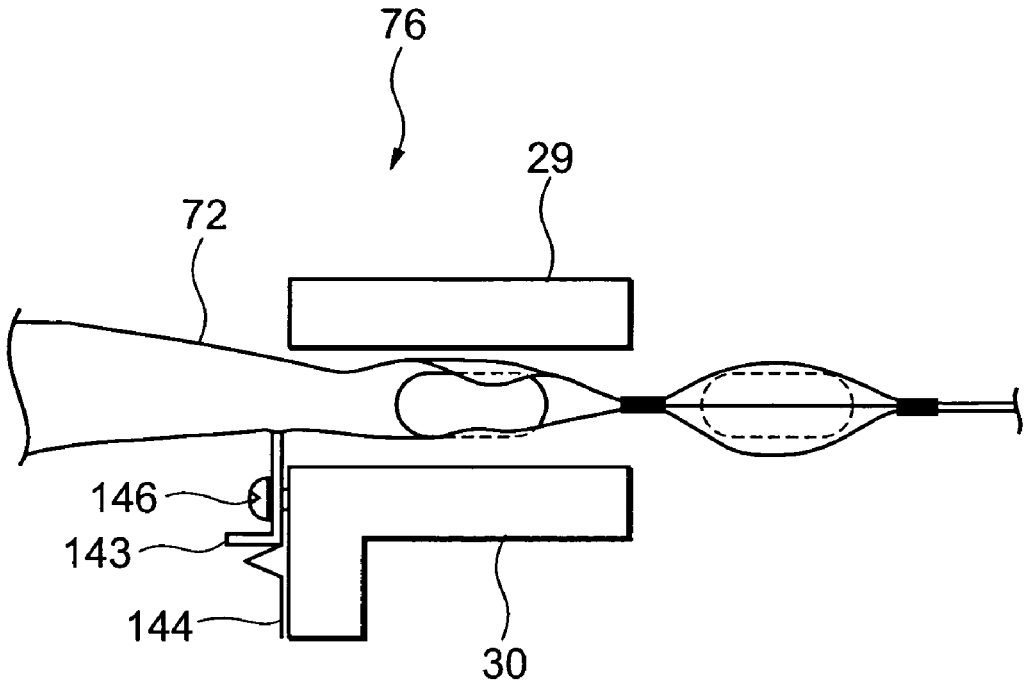
FIG. 18 is a diagram showing an advancing state of the packing paper at another heat seal head portion.
Figure 19:
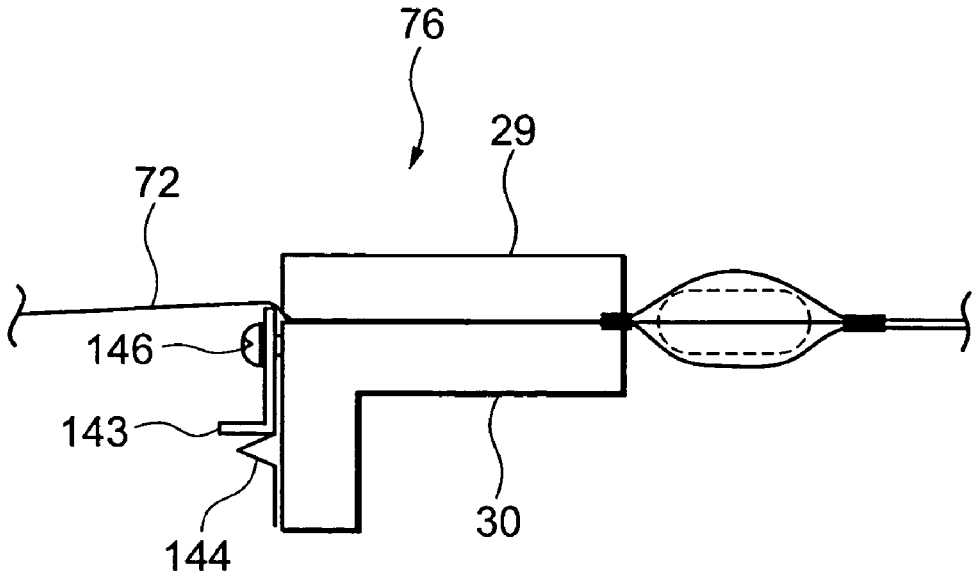
FIG. 19 is a diagram showing the state where a heat seal head of FIG. 18 is closed.

FIG. 18 shows a medicine supply apparatus 1 of another preferred embodiment of the present invention. In this embodiment, the packing paper shaping plate 140 is not provided in the neighborhood of the lower end of the width-narrowed portion 122. The other structure is the same as that of the foregoing medicine supply apparatus 1. Specifically, the medicine supply apparatus 1 in this embodiment is obtained by removing the packing paper shaping plate 140 from the foregoing medicine supply apparatus 1, so that there is provided only the tension applying means for applying tension in the direction to close the upper end opening of the packing paper 72. Also in this case, the packing paper 72 is drawn out from the roll 71 by the roller 77, then a medicine is projected into the packing paper 72 via the packing paper guide 123 and, when both heaters 29, 30 are closed, the opening of the packing paper 72 is, like in the foregoing, pushed toward the further side exceeding the contact surface of the heater 29 by the elastic pressure of the plate spring 144 via the movable member 143.

Thereby, the opening of the packing paper 72 is pressed against the contact surface of the heater 29. Therefore, even if a slack occurs at the opening of the packing paper 72 while it is closed, the slack can be absorbed by pushing the packing paper 72 to the side separating from the heater 30 to exceed the contact surface of the heater 29, by the elastic pressure of the plate spring 144 via the movable member 143. Consequently, wrinkles or slacks that are generated at the opening (heat-welded portion) upon heat welding of the packing paper 72, can be extended before carrying out the heat welding.

Figure 20:
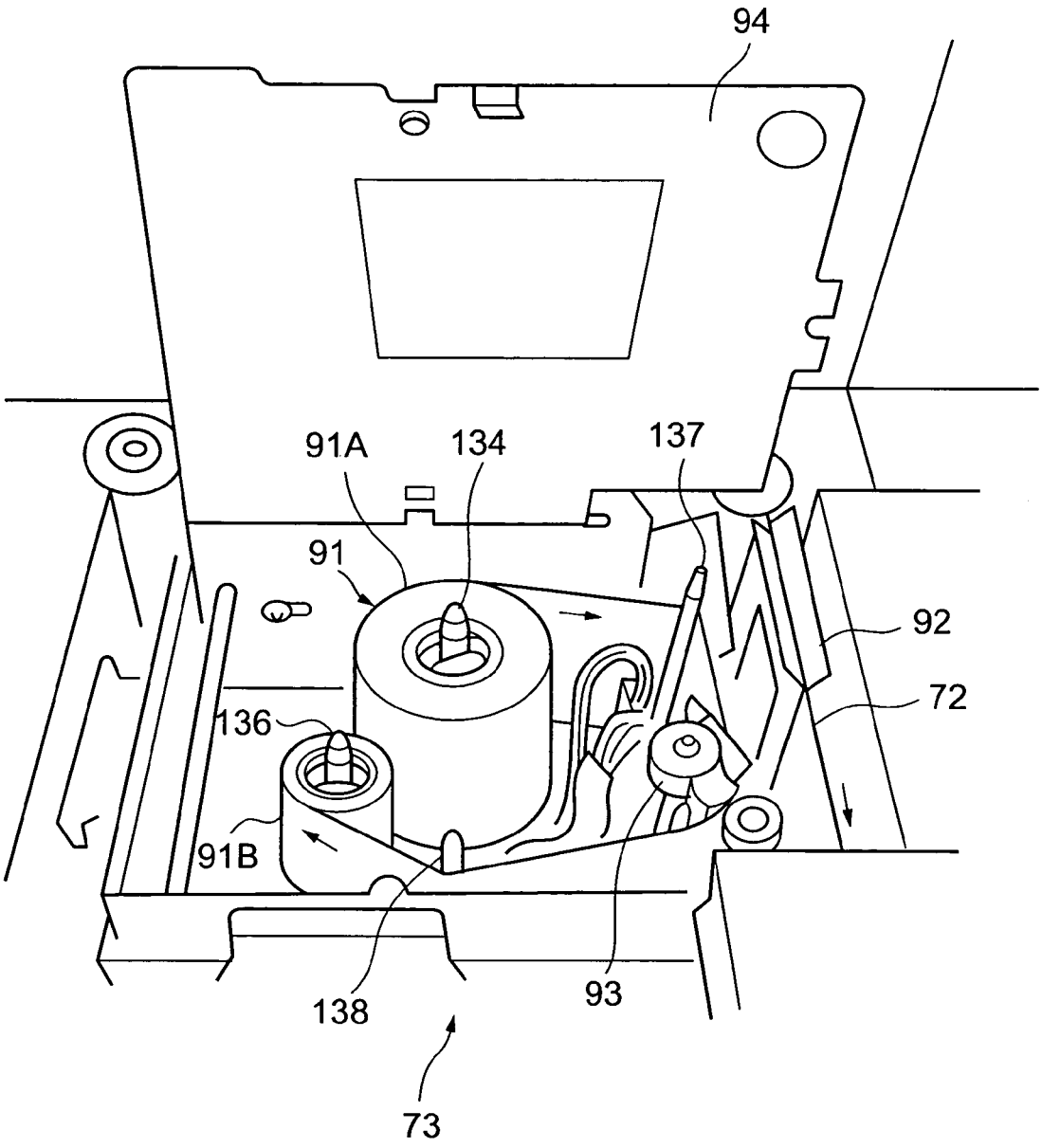
FIG. 20 is a perspective view of a printer of the medicine supply apparatus of FIG. 1.

Now, the printer 73 will be described. The printer 73 is a thermal transfer printer using an ink ribbon 91. As shown in FIG. 20, by pressing the packing paper 72 onto the color ink ribbon 91 by the use of a pressing plate 92, predetermined printing is carried out on the surface of the packing paper 72 using a thermal transfer head 93.

Numeral 94 denotes an open/close cover of the printer 73. Advancing directions of the ink ribbon 91 and the packing paper 72 are indicated by arrows in the figure. Numeral 134 denotes a supply bobbin of the ink ribbon 91 of the printer 73, and numeral 136 a take-up bobbin of the ink ribbon 91. Further, numerals 137 and 138 denote guide pins for guiding the ink ribbon 91 to the thermal transfer head 93. A supply side 91A of the ink ribbon 91 is attached to the supply bobbin 134, and a take-up side 91B thereof is attached to the take-up bobbin 136. Then, the ink ribbon 91 is extended over the guide pin 137, the thermal transfer head 93, and the guide pin 138 in order (see FIG. 20).

Now, an operation of the medicine supply apparatus 1 of the present invention having the foregoing structure will be described. It is assumed that the foregoing opening/closing plates 53, 53 are closed when the power is turned on. It is further assumed that the shelves 2 . . . attached with the tablet cases 3 . . . containing predetermined medicines, respectively, are attached in the case receiving portion 8 of the upper structural body 7A as described before.

When an operator inputs prescription data from the personal computer based on a prescription by a doctor, the controller of the medicine supply apparatus 1 identifies the tablet case 3 containing therein specified medicines based on the inputted prescription data, drives the drum motor thereof to rotate the discharge drum, thereby to discharge the medicines one by one. The discharged medicines are detected by the medicine detection sensor and counted. Then, when a predetermined quantity of the medicines is discharged, the drum motor is stopped. The discharged medicines enter the chute 32 formed by the paths 9, via the discharge chute of the tablet case 3, then are temporarily received by the opening/closing plate 53.

Then, the controller opens the opening/closing plate 53 to drop the medicines into the hopper 54. The medicines dropped into the hopper 54 enter the nozzle 74 via the lower end opening 54A, and are received on the first shutter plate 128 of the shutter 126 which is closed as shown in FIG. 10. Then, as described before, the controller opens the first shutter plate 128 by the driving means to pass the medicines through the packing paper guide 123, thereby to project the medicines into the packing paper 72. Then, after packing the medicines by the use of the packing machine 13 as described before, the packed medicines are offered to the exterior from the takeout port 82. In this event, by carrying out discharge of the next medicines at a time instant when the medicines dropped into the hopper 54 from the opening/closing plate 53, the controller shortens a time required for the packing. Further, the foregoing printing about the medicines to be packed is implemented by the printer 73 before the medicines are projected.

In the foregoing embodiments, the tension applying means is formed by the plate spring 144 and the movable member 143. However, the tension applying means is not limited thereto, and, for example, may be formed only by the movable member 143. In this case, the movable member 143 is fixedly screwed to the heater 30 in the state where the other side of the movable member 143 is projected over the heater 30 toward the side of the heater 29 by the predetermined distance. Thereby, inasmuch as the opening of the packing paper 72 is forced toward the heater 29, even if a slack occurs at the opening of the packing paper 72 while it is closed, the slack can be absorbed by pushing the packing paper 72 to the side separating from the heater 30 to exceed the contact surface of the heater 29 by the use of the movable member 143. On the other hand, the tension applying means may be formed only by an elastic member having springiness. In this case, by fixedly screwing one side of the elastic member to the heater 30 like the plate spring 144 and forming the other side of the elastic member up to the position of the other side of the movable member 143, a slack can be absorbed by pushing the packing paper 72 to the side separating from the heater 30 to exceed the contact surface of the heater 29 by an elastic pressure of the elastic member.

As described above in detail, according to the present invention, a medicine supply apparatus is for supplying a medicine discharged from a tablet case containing the medicine, and comprises a nozzle for discharging the medicine discharged from the tablet case, and a shutter rotatably provided in the nozzle for opening/closing a medicine drop path in the nozzle, wherein the shutter comprises a first shutter plate that has a size capable of closing the inside of the nozzle and is rotated, a second shutter plate swingably connected to the tip of the first shutter plate, and a guide for swinging the second shutter plate in a direction opposite to a direction of rotation of the first shutter plate in a final stage where the first shutter plate is opened, and wherein the tip of the second shutter plate is located in a position to narrow an outlet of the medicine drop path when the first shutter plate is opened. Therefore, if the medicine drops in a posture that is blocked at the outlet of the medicine drop path when the first shutter plate has been opened, the medicine is caught by the tip of the second shutter plate. Then, when the first shutter plate is rotated in a direction to be closed, the second shutter plate swings in a direction opposite to the direction of rotation of the first shutter plate. This swinging motion of the second shutter plate makes it possible to move the medicine blocked at the tip of the second shutter plate to thereby change the posture of the medicine. Thereby, it becomes possible to effectively solve the blocking of the medicine in the nozzle so as to drop the medicine smoothly.

Particularly, when the first shutter plate is opened, the medicine is forcibly blocked at the tip of the second shutter plate and, when the first shutter plate is rotated in the direction to be closed, the second shutter plate is rotated in the direction opposite to the direction of rotation of the first shutter plate to thereby rock the medicine caught at the tip of the second shutter plate. Therefore, it is possible to change the posture of the caught medicine quite easily, thereby to effectively solve the medicine blocking in the nozzle.

Further, according to the present invention, a medicine supply apparatus comprises a nozzle for projecting medicines discharged from a tablet case, into packing paper continuously drawn out, heat seal means for sealing by heat welding an upper end opening of the packing paper having received the medicines from the nozzle, and partitioning the packing paper per pack, and tension applying means for applying tension to the packing paper in a direction to close the upper end opening of the packing paper to be sealed by the heat seal means. Therefore, it becomes possible to prevent occurrence of wrinkles upon heat-welding the packing paper. Thereby, the sealing of the upper end opening of the packing paper can be suitably improved.

Further, according to the present invention, the tension applying means is movably provided and urged toward the packing paper by an elastic member. Therefore, it becomes possible to prevent excessive tension from being applied to the packing paper. Thereby, damage to the packing paper due to the applied tension can be reliably prevented.

Particularly, since the tension applying means is urged toward the side of the packing paper by the elastic member, even when the sizes or quantities of medicines projected into the packing paper differ from each other, occurrence of packing failure can be effectively suppressed.

What is claimed is:

1. A medicine supply apparatus for supplying a medicine comprising:

a tablet case containing the medicine;

a nozzle for discharging the medicine from said tablet case; and a shutter rotatably provided in said nozzle for opening/closing a medicine drop path in said nozzle;

wherein said shutter comprises a first shutter plate of a size capable of closing the inside of said nozzle and that is rotated, a second shutter plate swingably connected to the tip of said first shutter plate, and a guide for swinging said second shutter plate in a direction opposite to a direction of rotation of said first shutter plate in a final stage where said first shutter plate is opened, and wherein the tip of said second shutter plate is located in a position to narrow an outlet of said medicine drop path when said first shutter plate is opened.

2. A medicine supply apparatus as claimed in claim 1 further comprising:

a roll of packing paper in the state where said packing paper is open at its upper end and folded at its lower end;

wherein said nozzle projects the medicine discharged from said tablet case into said packing paper upper open end that is being continuously drawn out;

heat seal means for sealing by heat welding an upper end opening of said packing paper having received the medicines from said nozzle, and partitioning said packing paper per pack; and tension applying means for applying tension to said packing paper in a direction to close the upper end opening of said packing paper to be sealed by said heat seal means.

3. A medicine supply apparatus according to claim 2, wherein said tension applying means is movably provided and urged toward said packing paper by an elastic member.

* * * * *